US011112125B2

(12) United States Patent
Stewart et al.

(10) Patent No.: US 11,112,125 B2
(45) Date of Patent: Sep. 7, 2021

(54) OVEN RACK ASSEMBLIES WITH RELEASE MECHANISMS AND CATCHES

(71) Applicant: SSW Advanced Technologies, LLC, Fort Smith, AR (US)

(72) Inventors: Brian J. Stewart, Vincennes, IN (US); Jeffrey Alan Ambrose, Evansville, IN (US); Jason Robert Yochum, Evansville, IN (US)

(73) Assignee: SSW Advanced Technologies, LLC, Fort Smith, AR (US)

( * ) Notice: Subject to any disclaimer, the term of this patent is extended or adjusted under 35 U.S.C. 154(b) by 387 days.

(21) Appl. No.: 15/425,561

(22) Filed: Feb. 6, 2017

(65) Prior Publication Data

US 2017/0146246 A1 May 25, 2017

Related U.S. Application Data

(63) Continuation of application No. 11/676,756, filed on Feb. 20, 2007, now Pat. No. 9,587,838, which is a continuation-in-part of application No. PCT/US2006/045831, filed on Nov. 30, 2006.

(51) Int. Cl.

| | |
|---|---|
| ***F24C 15/16*** | (2006.01) |
| ***A47B 55/02*** | (2006.01) |
| ***A47L 15/50*** | (2006.01) |

(52) U.S. Cl.

CPC ..... *F24C 15/168* (2013.01); *A47B 55/02* (2013.01); *A47L 15/507* (2013.01); *F24C 15/16* (2013.01)

(58) Field of Classification Search

CPC ..... A47B 55/02; A47L 15/507; F24C 15/16; F24C 15/168

See application file for complete search history.

(56) References Cited

U.S. PATENT DOCUMENTS

| | | | | |
|---|---|---|---|---|
| 3,450,025 | A * | 6/1969 | Fleming | F24C 7/06 126/19 R |
| 3,730,467 | A | 5/1973 | Dutchburn | |
| 3,885,846 | A * | 5/1975 | Chuang | A47B 57/482 108/110 |
| 4,872,734 | A * | 10/1989 | Rechberg | A47B 88/493 312/333 |
| 6,148,813 | A | 11/2000 | Barnes | |
| 6,209,979 | B1 * | 4/2001 | Fall | H05K 7/1489 312/319.1 |
| 6,349,717 | B1 * | 2/2002 | Thompson | F24C 15/16 126/333 |

(Continued)

FOREIGN PATENT DOCUMENTS

WO WO2006/000523 1/2006

*Primary Examiner* — Jorge A Pereiro
*Assistant Examiner* — Logan P Jones
(74) *Attorney, Agent, or Firm* — Marshall, Gerstein & Borun LLP

(57) ABSTRACT

An oven rack assembly (1000) includes an oven rack (1008) and a slide system (1018). The slide system (1018) includes slide devices (1020) positioned at opposing sides of the oven rack (1008). A subframe (1040) is positioned below the slide devices (1020). Retention/release devices (1062) are mounted on the slide devices (1020) and are manually operable by a user so as to selectively retain the subframe (1040) in a stationary position or, alternatively, release the subframe (1040) so that the subframe (1040) can be removed from the oven (128').

2 Claims, 27 Drawing Sheets

(56) References Cited

U.S. PATENT DOCUMENTS

| | | | | |
|---|---|---|---|---|
| 6,663,204 | B2 * | 12/2003 | Atalla | A47B 96/025 211/153 |
| 6,938,617 | B2 | 9/2005 | Le | |
| 7,216,646 | B2 * | 5/2007 | Le | F24C 15/16 126/273 R |
| 7,316,179 | B2 * | 1/2008 | Geberzahn | F24C 15/16 126/339 |
| 7,703,453 | B2 * | 4/2010 | Hughes | F24C 15/16 123/332 |
| 2001/0044992 | A1 * | 11/2001 | Jahrling | A47B 55/02 24/563 |
| 2004/0112371 | A1 * | 6/2004 | Le | F24C 15/16 126/334 |
| 2005/0217501 | A1 * | 10/2005 | Babucke | F24C 15/168 99/450 |
| 2005/0218096 | A1 * | 10/2005 | Dunn | A47B 55/02 211/153 |
| 2007/0261199 | A1 | 11/2007 | Petri | |

* cited by examiner

OVEN RACK ASSEMBLIES WITH RELEASE MECHANISMS AND CATCHES

CROSS-REFERENCE TO RELATED APPLICATIONS

This application is a continuation of patent application Ser. No. 11/676,756 filed Feb. 20, 2007, which is a continuation-in-part of International Patent Application No. PCT/US2006/045831 filed Nov. 30, 2006.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

Field of the Invention

The present invention relates to oven products and, more particularly, to oven rack assemblies having release mechanisms for releasing oven sub-frames from oven liners, and rearwardly positioned catches for capturing the sub-frames.

Background Art

Various types of oven racks are well known in the industry. For example, steel wire oven racks are often manufactured from a steel rod which is drawn, so as to form steel wire. These oven racks formed of steel wire products can be coated with various types of materials. Also, oven racks and other oven-related articles can be manufactured from products other than steel. Of course, any type of oven rack or similar product which is positioned within an oven cavity during use must be capable of withstanding normal cooking temperatures which substantially exceed normal cooking temperatures. In addition, for ovens which employ self-cleaning cycles, the oven racks and other oven-related articles located within the oven itself must be capable of being subjected to and withstanding temperatures which substantially exceed normal cooking temperatures. For example, steel wire oven racks may be subjected to temperatures above 900° F. associated with self cleaning cycles, common in today's kitchen ovens.

One difficulty which has existed for a number of years in the industry relates to manipulation of oven racks. In many conventional ovens, the oven racks can be positioned at various vertically disposed positions, and be adjustable among the same. With the oven racks positioned as desired at various vertically adjusted locations, the oven racks often "slide" on ribs or roller bearing mechanisms positioned on the lateral sides of the oven cavity. These ribs, roller bearings or "ledges" may be separately manufactured and assembled components from the surfaces of the oven cavity and oven racks or, alternatively, may be integrated into the lateral surfaces of the oven cavity.

With respect to oven rack assemblies which can be extended, such rack assemblies traditionally fall within one of two types of applications. One particular application comprises an oven rack assembly which interacts directly with ribbed liners on the sidewalls of an oven interior. In a second application, the oven rack assembly interacts with a ladder frame connected to the sidewalls of an oven interior.

As an example, Barnes, et al., U.S. Pat. No. 6,148,813 issued Nov. 21, 2000, discloses a telescoping oven rack assembly for an oven cavity. The assembly includes a rack extendable upon a primary rack frame. In turn, the rack frame is mounted for sliding movement relative to the oven cavity. With this configuration, multiple extensions for the rack are available. The rack is supported upon guides carried by the rack frame, along with multiple sets of rollers. A secondary rack frame can be used to slidably support the primary rack frame, so that a further extension can be made.

Le, et al., U.S. Pat. No. 6,938,617 issued Sep. 6, 2005, discloses an oven rack assembly having full extension slides. The slides are mounted to an oven rack, and oven rack frames or wire racks provide full extension from an oven enclosure. The rack frame is mounted to oven walls or the slides are coupled to wire racks along the oven side walls. This patent discloses the concept of the user of ladder frames.

In accordance with the foregoing, it is known from the prior art to utilize items such as a subframe and/or attachable brackets for the slidable oven rack assembly. In these prior art configurations, the subframe may support the weight of items placed on the oven rack, and keep the assembly in place, relative to the ladder tracks or the ribbed liners. In prior art systems employing attachable brackets, the brackets provide a fixed connection between the oven rack and the ladder racks. However, for various purposes, including cleaning, repair and the like, it is advantageous to provide means for releasing the coupling between the subframe or brackets from the liners.

Still further, when manipulating the subframe, one difficulty which can arise is that the subframe may tend to tip away from a horizontal plane. Accordingly, it would be advantageous to provide means for preventing such undesired movement.

SUMMARY OF THE INVENTION

In accordance with one aspect of the invention, an oven rack assembly is adapted for use within an oven cavity having oven cavity liner sides. The oven rack assembly includes an oven rack with means for supporting items to be cooked or otherwise heated within the oven cavity. The oven rack is manually extendable between a retracted position within the oven cavity, and an extended position where the oven rack is moved forwardly relative to the oven cavity. A slide system is provided which is coupled to the oven rack, and provides the capability of the oven rack to move between the retracted position and the extended position. A subframe is provided, with the subframe coupled to the slide system and normally positioned in a first location within the oven cavity. Retention/release means are manually operable by a user for retaining the subframe in the first location. In accordance with one aspect of the invention, the retention/release means are mounted to the slide system and comprise interaction means for maintaining retention of the subframe in the first location, through interaction with the oven liner sides.

The oven rack assembly can include lever means connected to the retention/release means. The lever means can be manually operable by a user for releasing the interaction means from interaction with the oven liner sides. In this manner, the subframe is permitted to be moved from the first location. The subframe can be maintained substantially stationary when the oven rack is moved from a retracted position to an extended position. The slide system can include a pair of opposing slide devices, with each of the slide devices mounted to an opposing side of the oven rack. The retention/release means can include at least one pair of retention/release devices. One of the pair is mounted to one of the slide devices, while the other of the pair is mounted to the other of the slide devices.

In accordance with more specific aspects of the invention, the retention/release devices can include tab means pivotable between a retaining position and a release position. When the tab means are in a retaining position, the subframe is maintained in a stationary state within the oven cavity. The lever means can include a pair of lever brackets. Each of the lever brackets can be coupled to a corresponding one of the retention/release devices. The lever brackets can be manually operable by a user, so as to move the tab means between the retention position and the release position.

Each of the retention/release devices can include a retention spring coupled to the tab means. The retention spring can be configured and positioned so that when a user releases external forces exerted on the lever brackets, the tab means can move to the retaining position. As an alternative, the retention springs are not absolute requirements in accordance with principal aspects of the invention. Instead, the retention/release devices can be configured so that if the tab means are in the release position, and the user releases external forces exerted on the lever brackets, the tab means will remain in the release position.

In accordance with other aspects of the invention, an oven rack assembly in accordance therewith can be adapted for use with an oven cavity having oven liner sides and/or an oven liner rear surface. The assembly can include an oven rack extendable between retracted and extended positions, and a slide system coupled to the oven rack for moving the rack between these positions. A subframe can form a part of the oven rack assembly and support the oven rack and the slide system. The subframe can include a pair of catch portions formed at or near the rear of the subframe. The oven rack assembly can also include catch support means mounted within the oven cavity. The catch support means can include a series of catches for releasably capturing the catch portions on the subframe. In this manner, the subframe is substantially prevented from tipping forwardly as a result of the weight of the subframe and/or cantilever forces exerted on the subframe by the oven rack and the slide system. Still further, the catch support means operate so as to hold the subframe in place, thereby facilitating sliding movement of the oven rack and slide system.

The catch portions can include a pair of laterally extending wire sections. Correspondingly, the catch support means can include a pair of vertically oriented ladder catches. The pair of ladder catches can be fixedly attached to a rear surface and/or side surfaces of the oven cavity.

Each of the ladder catches can be vertically disposed and include a series of spaced apart ladder catch openings. Each of the ladder catch openings can open toward the front of the oven rack assembly. The oven rack assembly can also include a series of ladder catch slots located at the rear of each of the ladder catch openings. Each of the ladder catch slots can open downwardly toward a corresponding one of the ladder catch openings. Still further, the subframe can be mounted to the rear ladder catches by inserting the catch portions of the subframe into desired ladder catch openings on each of the rear ladder catches. In accordance with a further concept of the invention, the oven rack assembly can include an oven rack which comprises a permanent rack and a removable half-rack.

DETAILED DESCRIPTION OF THE INVENTION

The principles of the invention are disclosed, by way of example, in oven rack assemblies 1000, 1200 and 1400 as described herein and illustrated in FIGS. 19-34. In accordance with certain aspects of the invention, the oven rack assemblies disclosed herein may be used with liner ribs or similar liner support elements, with release mechanisms which facilitate release of the oven rack assemblies from the oven liners. In accordance with certain other aspects of the invention, the oven rack assemblies are also adapted to releasably engage rearwardly located ladders or other catch means positioned at the rear of the oven cavity. The catch means assist in preventing the oven rack assemblies from tipping forward or falling out of the oven cavity during movement.

For purposes of describing additional background regarding oven rack assemblies, other embodiments of certain types of oven racks are illustrated in FIGS. 1-18, and described in subsequent paragraphs herein. These oven rack embodiments are disclosed in commonly assigned International PCT Patent Application entitled "Full and Partial Extension Oven Rack Assembly" and filed Nov. 30, 2006. Following the description of the oven racks as illustrated in FIGS. 1-18, the principles of the current invention will be described with respect to FIGS. 19-34.

Figure 2:
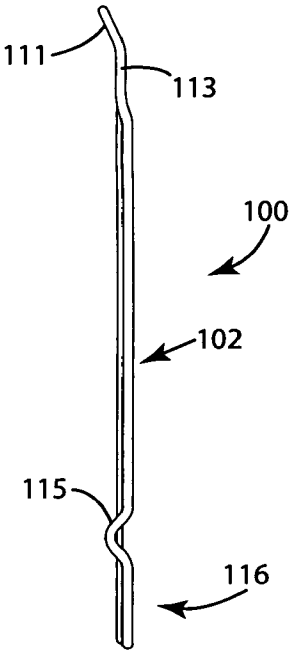
FIG. 2 is a side elevational view of the oven rack and handle of FIG. 1.
Figure 1:
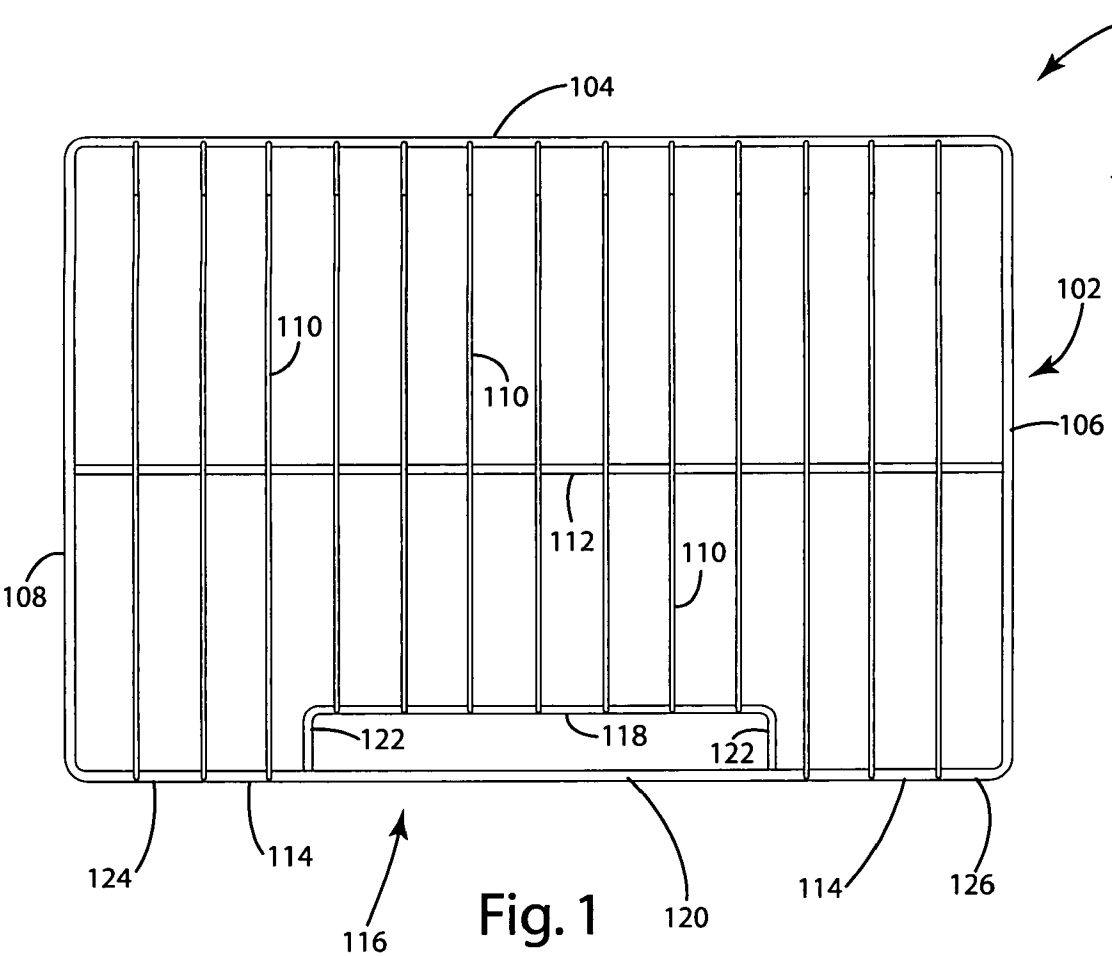
FIG. 1 is a plan view of a prior art oven rack having a handle.

More specifically, and first primarily with respect to FIGS. 1 and 2, a handle rack 100 is illustrated. The handle rack 100 includes an oven rack 102. The oven rack 102 is in part a substantially conventional oven rack, with the exception of the handle 116 as described in subsequent paragraphs herein. The oven rack 102 includes an elongated rear brace 104 which is positioned adjacent the rear of the oven cavity when the oven rack 102 is in its retracted and normal position within the oven cavity (not shown). The rear brace 104 and other components of the oven rack 102 can be manufactured in a conventional manner of steel wire products or the like. Alternatively, other types of materials and structures may be utilized for the rear brace and other components of the oven rack.

Interconnected or otherwise integral with the rear brace 104 is a right brace 106 which extends perpendicular to the rear brace 104. The right brace 106 extends between the forward and the rear sections of the oven rack 102, and essentially acts as a support brace for other elements of the oven rack 102. Also, when the oven rack 102 is placed within the oven cavity, the right brace 106 will typically rest or otherwise be releasably secured on a rib or other conventional element of the oven cavity. Corresponding to the right brace 106, the oven rack 102 also includes a left brace 108. The left brace 108 is parallel to the right brace 106 and is interconnected to or otherwise integral with the rear brace 104. As with the right brace 106, the left brace 108 extends between the rear and front portions of the oven rack 102. As with the right brace 106, the left brace 108 rests upon or is otherwise releasably secured to a rib or similar component of the oven cavity (not shown).

Positioned intermediate the right brace 106 and the left brace 108 are a series of parallel and longitudinally extending elongated support members 110. The support members 110 act as the principal support members of the oven rack 102 for supporting items to be heated and cooked within the oven cavity. The rear ends of the support members 110 are connected to the rear brace 104 by suitable means, such as welding or the like. As illustrated in FIG. 2, the right brace 106, left brace 108 and the support members 110 include a series of intermediate forms 113 located near the rear portions of the braces 106, 108 and support members 110. The intermediate forms 113 are connected to or are otherwise integral with angled forms 111 also shown in FIG. 2. The angled configuration of the forms 111 assist in preventing items placed on the support members 110 from falling off of the oven rack 102 over the rear brace 104.

The oven rack 102 also includes a central brace 112, extending perpendicular to the right brace 106 and the left brace 108. The central brace 112 is also positioned substantially intermediate from the rear brace 104 and the front brace 114. The central brace 112 provides for additional support for items placed on the oven rack 102 for purposes of heating or cooking. The central brace 112 may be connected to the support members 110, right brace 106 and left brace 108 in any conventional manner. For example, welding may be utilized.

In addition to the foregoing, the oven rack 102 also includes a front brace 114. The front brace 114, with reference to the illustration in FIG. 1, includes a left portion 124 and a right portion 126. The front brace 114, comprising left and right portions 124, 126, respectively, provides a forward bracing means for the oven rack 102. As illustrated in FIG. 1, three of the support members 110 are interconnected to the left portion 124 of the front brace 114, while three of the support members 110 are also interconnected to the right portion 126 of the front brace 114.

The handle rack 100 comprises not only the oven rack 102, but also the handle 116. The handle 116 is primarily illustrated in FIG. 1. More specifically, the handle 116 includes a rear handle brace 118 having an elongated configuration as shown in FIG. 1. The rear handle brace 118 extends parallel to the rear brace 104 and the central brace 112. As illustrated in FIG. 1, the intermediate seven support members 110 have one end of each of the same interconnected to the rear handle brace 118. Interconnected to or otherwise integral with the rear handle brace 118 are a pair of handle sides 122. The handle sides 122 extend substantially parallel to the support members 110, right brace 106 and left brace 108. Correspondingly, the handle 116 also includes a front handle brace 120. The front handle brace 120, as illustrated in FIG. 1, is elongated and is positioned substantially parallel to the rear handle brace 118. The handle sides 122 are integral with or otherwise appropriately interconnected to the front handle brace 120. Also, if desired the front handle brace 120 can actually be a brace which is integral with the front brace 114 comprising the left portion 124 and the right portion 126.

With the configuration of the handle rack 100' comprising the oven rack 102 and the handle 116 as described in the foregoing paragraphs, a handle is provided for purposes of manual manipulation in extending and retracting the oven rack 102 from an oven cavity (not shown). More specifically, with the oven rack 102 in a normal position within an oven cavity, the user may open an oven door (not shown). The handle 116 will be adjacent the oven door. For purposes of extending the oven rack 102 out of the oven cavity, the user may manually grip the front handle brace 120, and exert forces in a direction corresponding to the perpendicular direction from the rear brace 104 to the front handle brace 120. These forces will cause the oven rack 102 to be extended outwardly from the oven cavity.

As primarily illustrated in FIG. 2, the oven rack 102 also includes a pair of bosses 115 which are located within the right brace 106 and the left brace 108. The bosses 115 are conventional in many oven racks, and comprise a means for providing some securing forces when the oven rack is in its conventional position within the oven cavity. That is, the bosses 115 will typically "mate" with corresponding indents located in ribs or ledges on each side surface of the oven cavity. With this type of mating relationship, the user may need to exert partially upwardly directed forces so as to lift the bosses 115 out of the indents when extending the oven rack 102 out of the oven cavity.

In accordance with the foregoing, the handle rack 100 provides not only the oven rack 102, but also provides a handle 116 for facilitating manual movement of the oven rack 102 between extended and retracted positions relative to the oven cavity (not shown). As earlier mentioned, the handle 116 can be utilized to extend the oven rack 102 out of the oven cavity. Correspondingly, a user may manually grip the front handle brace 120 and exert forces rearwardly against the oven rack 102 for purposes of retracting the oven rack 102 in to the oven cavity.

The handle rack 100 also includes means for supporting the handle rack within the oven cavity. Means are also provided for supporting items to be cooked or otherwise heated within the oven cavity, and the handle is secured to the oven rack at a front portion of the rack, positioned adjacent the oven door. Also in accordance with the foregoing, the handle is sized and configured so that an opening is formed between a front portion of the handle, and a front portion of the oven rack. In accordance with the foregoing, the opening is a side sufficient so that a user can readily grip the front portion of the handle, so that the oven rack can be extended from or retracted into the oven cavity. For this purpose, the opening formed between the front handle brace 120 and the rear handle brace 118 should be sufficient so that a user is capable of gripping the front handle brace 120 in a convenient manner, for purposes of extending or retracting the oven rack 102. That is, the opening between the front and rear braces 120, 118 should permit a user's hand to fit therethrough, so as to conveniently grip the brace 120.

Figure 4:
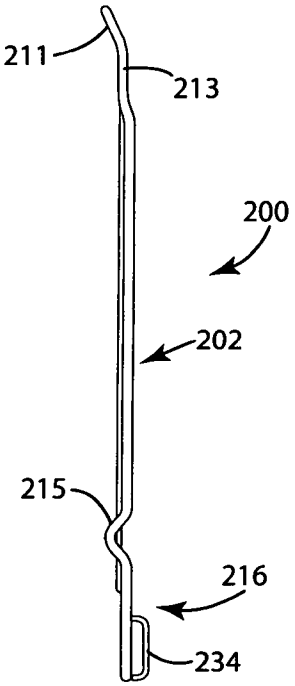
FIG. 4 is a side elevational view of the second embodiment of the oven rack and handle illustrated in FIG. 3.
Figure 3:
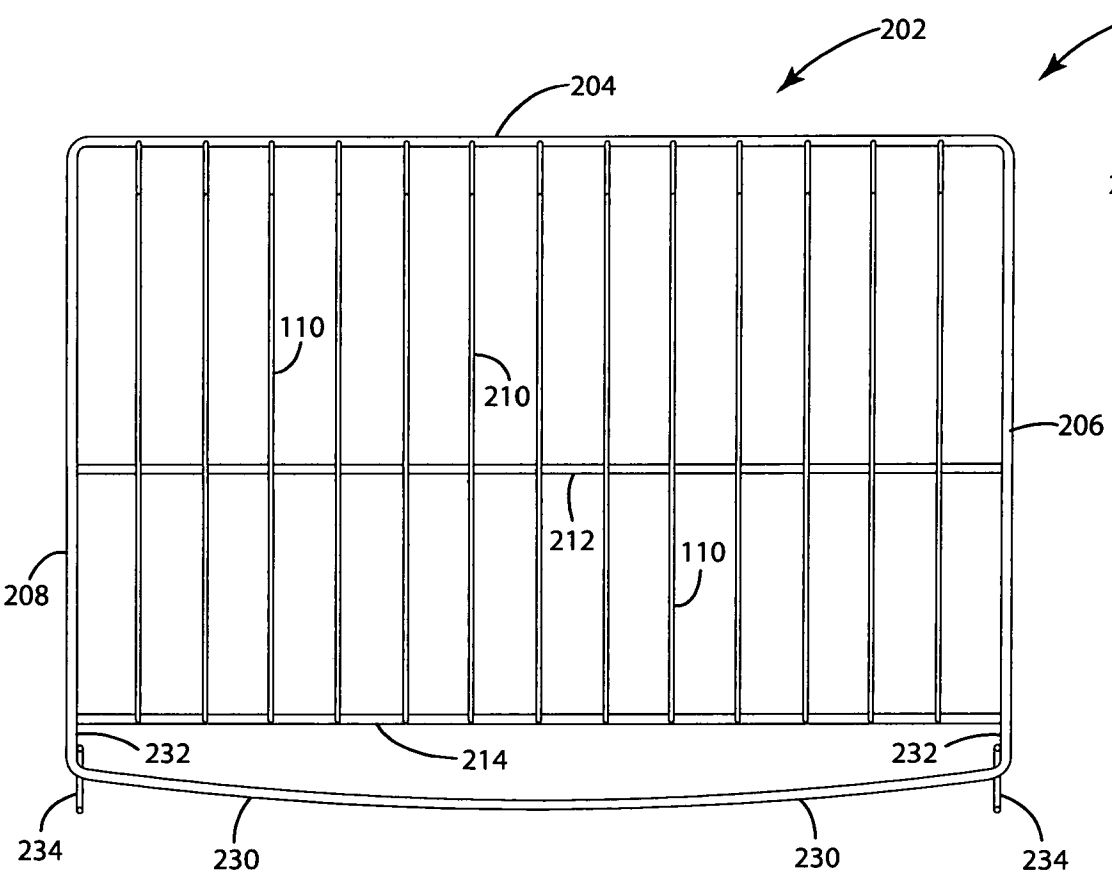
FIG. 3 is a plan view of a second embodiment of a prior art oven rack and handle.

A second embodiment of a handle rack is illustrated in FIGS. 3 and 4 as handle rack 200. The handle rack 200 includes an oven rack 202. The oven rack 202 is in part a substantially conventional oven rack, with the exception of the handle 216 as described in sub sequent paragraphs herein. as with the oven rack 102, the oven rack 202 includes an elongated rear brace 204 positioned adjacent the rear of the oven cavity when the oven rack 202 is in its retracted and normal position within the oven cavity (not shown).

Interconnected or otherwise integral with the rear brace 204 is a right brace 206 which extends perpendicular to the rear brace 204. The right brace 206 extends between the forward and rear sections of the oven rack 202, and essentially acts as a support brace for other elements of the oven rack 202. Also, when the oven rack 202 is placed within the oven cavity, the right brace 206 will typically rest or otherwise be releasably secured on a rib or other conventional element of the oven cavity. Corresponding to the right brace 206, the oven rack 202 also includes a left brace 208. The left brace 208 is parallel to the right brace 206 and is interconnected or otherwise integral with the rear brace 204. As with the right brace 206, the left brace 208 extends between the rear and front portions of the oven rack 202. As with the right brace 206, the left brace 208 rests upon nor is otherwise releasably secured to a rib or similar component of the oven cavity (not shown).

Positioned intermediate the right brace 206 and the left brace 208 are a series of parallel and longitudinally extending elongated support members 210. The support members 210 act as the principal support members of the oven rack 202 for supporting items to be heated and cooked within the oven cavity. The rear ends of the support members 210 are connected to the rear brace 204 by suitable means, such as welding or the like. as illustrated in FIG. 4, the right brace 206, left brace 208 and the support members 210 include a series of intermediate forms 213 located near the rear portions of the braces 206, 208 and support members 210. The intermediate forms 213 are connected to or are otherwise integral with angled forms 211 also shown in FIG. 4. The angled configuration of the forms 211 assist in preventing items placed on the support members 210 from falling off of the oven rack 202 over the rear brace 204. The oven rack 202 also includes a central brace 212, extending perpendicular to the right brace 206 and the left brace 208. The central brace 212 is also positioned substantially intermediate from the rear brace 204 and the front brace 214. The central brace 212 provides for additional support for items place don the oven rack 202 for purposes of heating or cooking. The central brace 212 may be connected to the support members 210, right brace 206 and left brace 208 in any conventional manner. For example, welding may be utilized.

In addition to the foregoing, the oven rack 202 also includes a front brace 214. The front brace 214 provides a forward bracing means for the oven rack 202. As illustrated in FIG. 3, each of the support members 210 is interconnected at the ends thereof to the front brace 214.

The handle rack 200 not only comprises the oven rack 202, but also the handle 216. The handle 216 includes a curved front section 230 as primarily shown in FIG. 3. The front section 230 extends across the entirety of the front portion of the oven rack 202. The front section 230 includes a single element having a rounded and elongated configuration, and provides a means for a user to manually grip a portion of the handle rack 200, for purposes of extending and retracting the oven rack 202. Integral with or otherwise connected to the front section 230 are a pair of opposing side portions 232. As illustrated in FIG. 3, and if desired, the side portions 232 can be made integral with the right brace 106 and the left brace 108, as well as the front section 230.

As with the handle rack 100, manual forces may be exerted on the oven rack 202 through the handle 216 for purposes of extending and retracting the oven rack 202 from an oven cavity. Also, as with the oven rack 102 previously described herein and having a pair of bosses 115, the oven rack 202 can also have a pair of bosses 215 having the same functions as the bosses 115.

Figure 6:
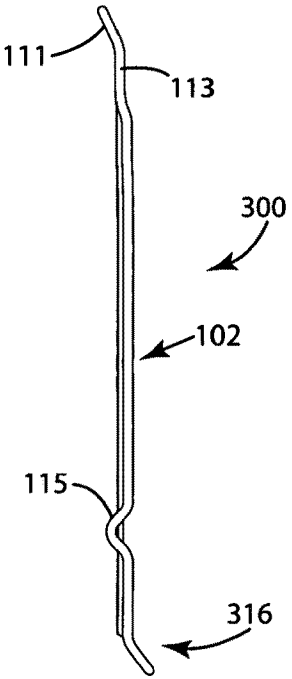
FIG. 6 is a partial side elevational view of the oven rack and handle illustrated in FIG. 5.
Figure 5:
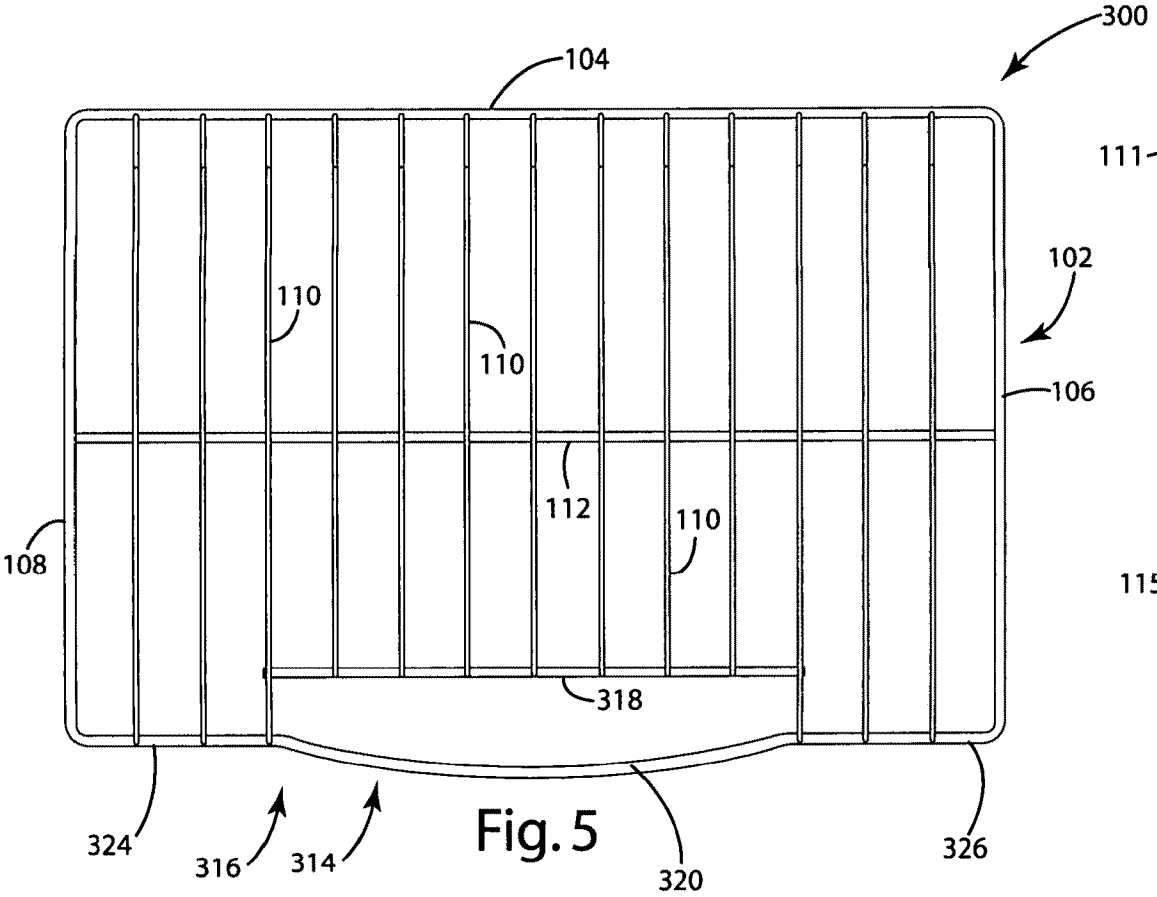
FIG. 5 is a plan view of a third embodiment of a prior art oven rack and handle.

A third embodiment of a handle rack is illustrated in FIGS. 5 and 6 as handle rack 300. For purposes of brevity, elements of handle rack 300 which correspond to elements of handle rack 100 are shown by numerical references which correspond to identically structured and identically functional elements numerically referenced in FIGS. 1 and 2. However, in accordance with the third embodiment of the invention, the handle rack 300 comprises not only the oven rack 102 but also the handle 316. More specifically, the handle 316 includes a rear handle brace 318 having an elongated configuration as illustrated in FIG. 5. The rear handle brace 318 extends parallel to the rear brace 104 and the central brace 112. As illustrated in FIG. 5, the intermediate seven support members 110 have one end of each of the same interconnected to the rear handle brace 318. Also, each opposing end of the rear handle brace 318 is preferably interconnected to one of the support members 110, again as illustrated in FIG. 5.

In addition to the foregoing, the oven rack 102 illustrated in FIG. 5 also includes a front brace 314. The front brace 314, with reference to the illustration in FIG. 5, includes a left portion 324 and a right portion 326. The front brace 314, comprising left and right portions 324, 326, respectively, provides a forward bracing means for the oven rack 102. As illustrated in FIG. 5, three of the support members 110 are interconnected to the left portion 324 of the front handle brace 314, while three of the support members 110 are also interconnected to the right portion 326 of the front handle brace 314. The handle rack 300 comprises not only the oven rack 102, but also the handle 316. The handle 316 is primarily illustrated in FIG. 5. More specifically, the handle 316 includes the rear handle brace 318 previously described herein. Also, the handle 316 includes a front handle brace 320. The front handle brace 320, as illustrated in FIG. 5, is elongated and is positioned in a manner so as to have a curved configuration. In addition, as illustrated primarily in FIG. 6, the front handle brace 320 may be angled downwardly. If desired, the front handle brace 320 can actually be a brace which is integral with the front brace 314 comprising the left portion 324 and the right portion 326.

With the configuration of the handle rack 300 comprising the oven rack 102 and the handle 316 as described in the foregoing paragraphs, a handle is provided for purposes of manual manipulation and extending and retracting the oven rack 102 from an oven cavity (not shown). More specifically, with the oven rack 102 in a normal position within an oven cavity, the user may open an oven door (not shown). The handle 316 will be adjacent the oven door. For purposes of extending the oven rack 102 out of the oven cavity, the user may manually grip the front handle brace 320, and exert forces in a direction corresponding to the perpendicular direction from rear brace 104 to front handle brace 320. These forces will cause the oven rack 102 to be extended outwardly from the oven cavity. Correspondingly, a user may manually grip the front handle brace 320 and exert forces rearwardly against the oven rack 102 for purposes of retracting the oven rack 102 into the oven cavity.

Figure 8:
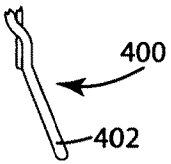
FIG. 8 is a side elevational view of the oven rack and handle illustrated in FIG. 7.
Figure 7:
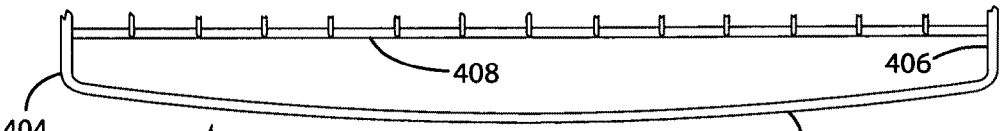
FIG. 7 is a partial plan view of a fourth embodiment of a prior art oven rack and handle.

A fourth embodiment of a handle is illustrated as handle 400 in FIGS. 7 and 8. In this configuration, the handle 400 includes a curved front handle brace 402 having side portions 404, 406. The front handle brace 402 has a curved configuration that extends across the entirety of the width of an interconnected oven rack (not shown). The side portions 404, 406 may be interconnected to or otherwise integral with the front handle brace 402 and/or left and right side braces of the interconnected oven rack. Also, the side portions 404, 406 and the front handle brace 402 may be angled downwardly as illustrated in FIG. 8. Still further, the handle 400 may include a front brace 408 positioned rearwardly of the front handle brace 402. The front brace 408 may provide a bracing and supporting means for interconnected support members of the oven rack (not shown).

Figure 10:
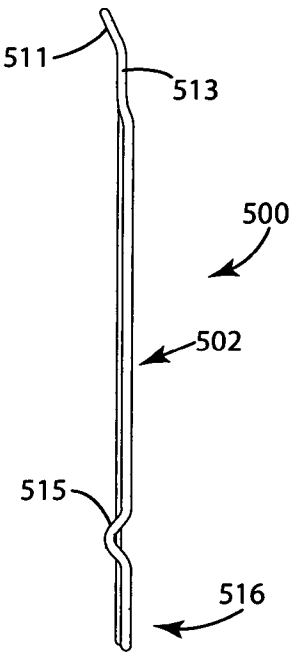
FIG. 10 is a side view of the oven rack illustrated in FIG. 9.
Figure 9:
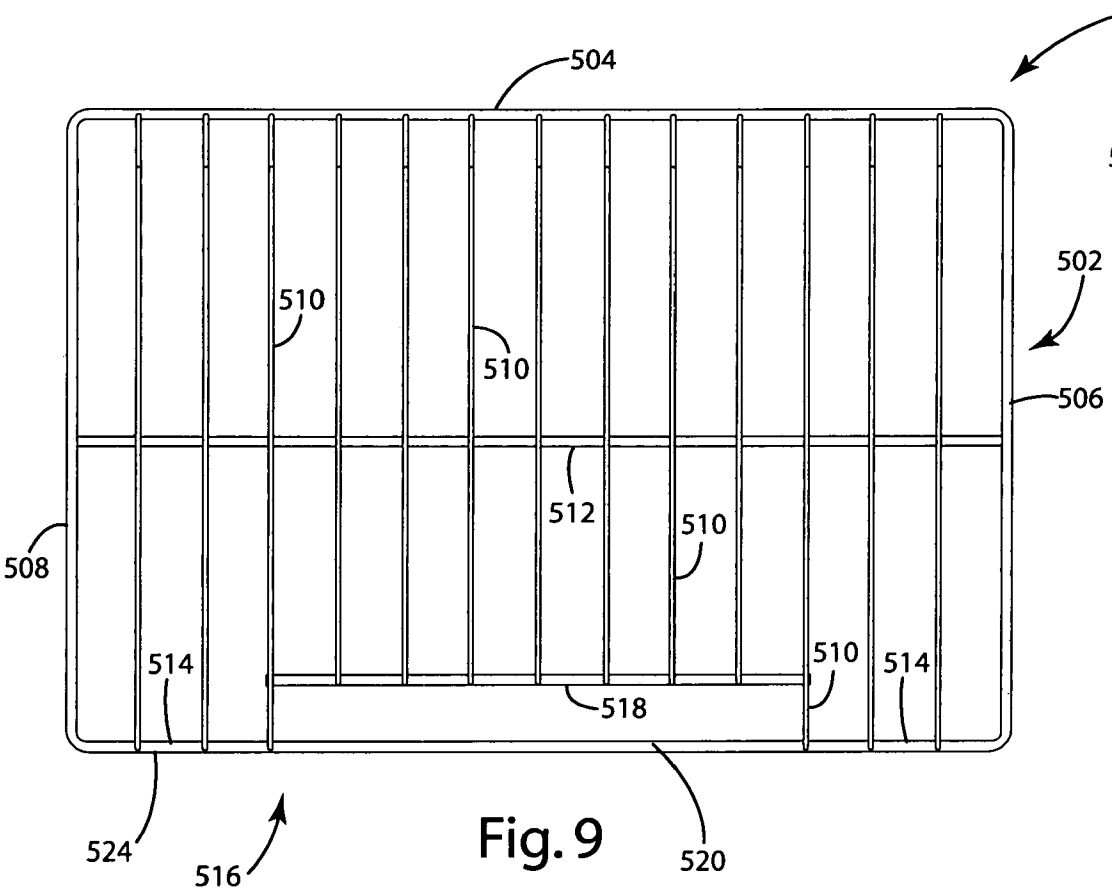
FIG. 9 illustrates a plan view of a fifth embodiment of a prior art oven rack and handle.

A fifth embodiment of a handle rack is illustrated as handle rack 500 in FIGS. 9 and 10. The handle rack 500 has a configuration which is similar to the handle rack 100 illustrated and described herein with respect to FIGS. 1 and 2. More specifically, the handle rack 500 includes an oven rack 502 with a handle 516. The oven rack 502 includes an elongated rear brace 504, positioned adjacent the rear of the oven cavity when the oven rack 502 is in its retracted and normal position. Interconnected to or otherwise integral with the rear brace 504 is a right brace 506 extending perpendicular to the rear brace 504. The right brace 506 extends between the forward and rear sections of the oven rack 502, and essentially acts as a support brace for other elements of the oven rack 502. Also, when the oven rack 502 is placed within the oven cavity, the right brace 506 will typically rest or otherwise be releasably secured on a rib or other conventional element of the oven cavity. The oven rack 502 also includes a left brace 508, parallel to the right brace 506 and interconnected to or otherwise integral with the rear brace 504. As with the right brace 506, the left brace 508 extends between the rear and front portions of the oven rack 502. The left brace 508 rests upon or is otherwise releasably secured to a rib or similar component of the oven cavity.

Positioned intermediate the right brace 506 and left brace 508 are a series of parallel and longitudinally extending elongated support members 510. The support members 510 act as the principal support members of the oven rack 502 for supporting items to be heated and cooked within the oven cavity. The rear ends of support members 510 are connected to the rear brace 504 by suitable means, such as welding or the like. As illustrated in FIG. 10, the right brace 506, left brace 508 and supported members 510 include a series of intermediate forms 513 located near the rear portions of the braces 506, 508 and support members 510. The intermediate forms 513 are connected to or are otherwise integral with angled forms 511 also shown in FIG. 10. The angled configuration of the forms 511 assists in preventing items placed on the support members 510 from falling off of the oven rack 502 over the rear brace 504.

The oven rack 502 also includes a central brace 512, extending perpendicular to the right brace 506 and left brace 508. The central brace 512 is also positioned intermediate the rear brace 504 and front brace 514. The central brace 512 provides for additional support for items placed on the oven rack 502 for purposes of heating or cooking. The central brace 512 may be connected to the support members 510, right brace 506 and left brace 508 in any conventional manner. For example, welding may be utilized.

The oven rack 502 also includes a front brace 514. The front brace 514, with reference to FIG. 9, includes a left portion 524 and a right portion 526. The front brace 514 provides a forward-bracing means for the oven rack 502. As illustrated in FIG. 9, three of the support members 510 are interconnected to the left portion 524 of the front brace 514, while three others of the support members 510 are interconnected to the right portion 526 of the front brace 514.

The handle rack 500 comprises not only the oven rack 502, but also the handle 516. The handle 516 is primarily illustrated in FIG. 9. More specifically, the handle 516 includes a rear handle brace 518, having an elongated configuration as shown in FIG. 9. The rear handle brace 518 extends parallel to the rear brace 504 and the central brace 512. As illustrated in FIG. 9, seven of the intermediate support members 510 have one end of each of the same interconnected to the rear handle brace 518.

In the handle rack 100 illustrated in FIGS. 1 and 2, as previously described herein, the handle 116 included a pair of handle sides 122 which are integral with a rear handle brace 118. In the particular handle rack 500 illustrated in FIGS. 9 and 10, although similar to the handle rack 100, the handle rack 500 does not includes any separate elements which could be characterized as "handle sides" separate and apart from the support members 510. Instead, the sides of the opening formed in the handle 516 comprise forward most sections of each of a pair of the supporting elements 510. That is, as specifically shown in FIG. 9, two of the supporting elements 510 extend from the rear brace 504 to the front brace 514, and also form the sides of the opening of the handle 516. In this regard, handle 516 also includes a front handle brace 520. The front handle brace 520, as illustrated in FIG. 9, is elongated and positioned substantially parallel to the rear handle brace 518. If desired, the front handle brace 520 can actually be a brace which is integral with the front brace 114 comprising the left portion 524 and the right portion 526.

The operation of the handle rack 500 substantially corresponds to the operation of the handle rack 100 previously described herein. That is, the user may manually grip the front handle brace 520, and exert forces in a direction corresponding to a perpendicular direction between the rear brace 504 and the front handle brace 520. These forces will cause the oven rack 502 to be extended outwardly or retracted inwardly relative to the oven cavity.

Figure 12:
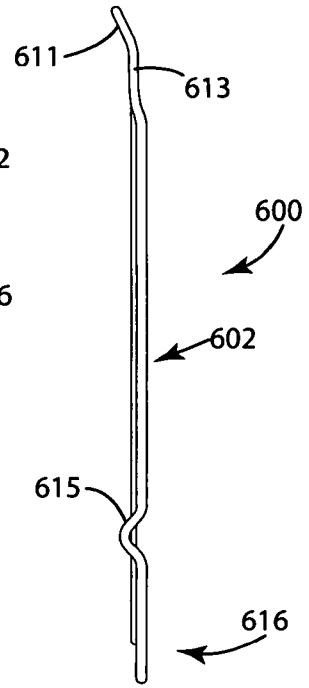
FIG. 12 is a side view of the oven rack illustrated in FIG. 11.
Figure 11:
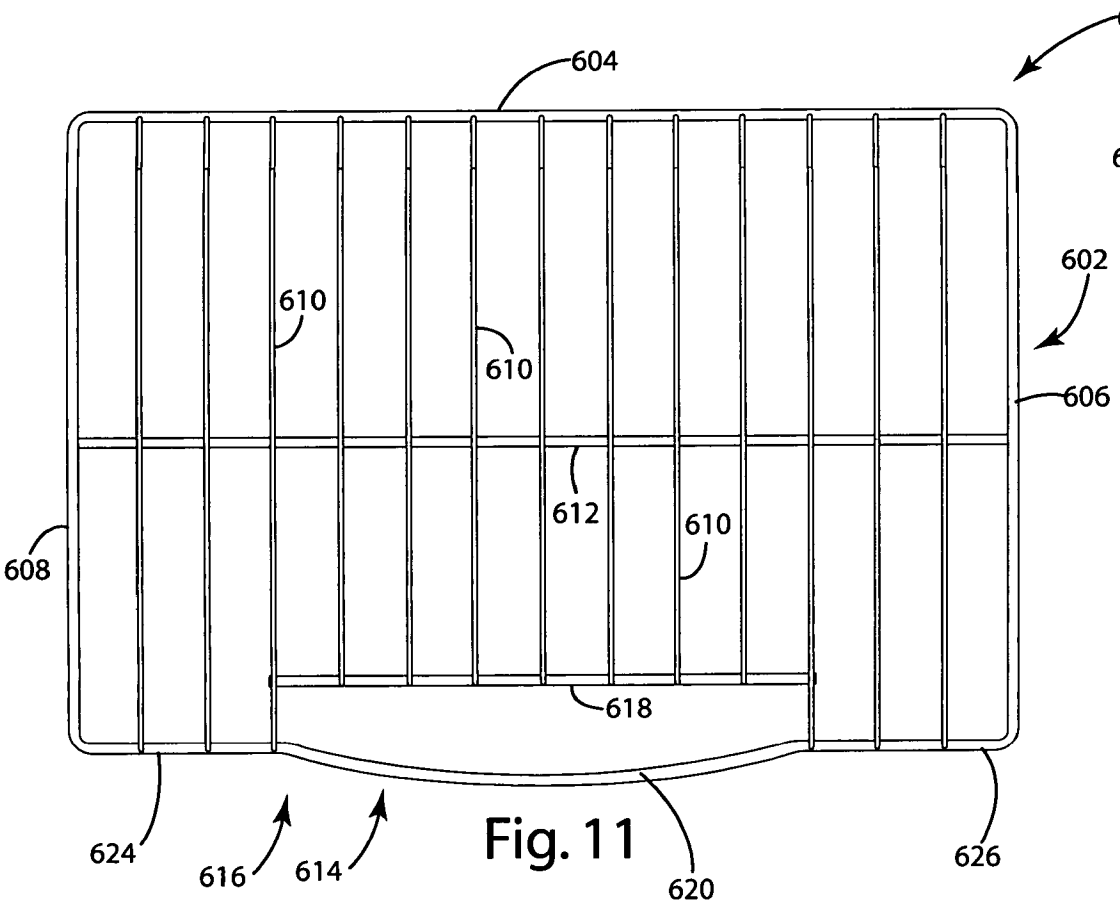
FIG. 11 is a still further embodiment of a prior art oven rack, comprising an oven rack and a handle.

A still further embodiment of a handle rack is illustrated as handle rack 600 in FIGS. 11 and 12. The handle rack 600 has a configuration which is relatively similar to the handle rack 300 previously described herein with respect to FIGS. 5 and 6. More specifically, the handle rack 600 includes an oven rack 602 and a handle 616. The oven rack 602 includes an elongated rear brace 604, right brace 606 and left brace 608. In addition, positioned intermediate the right brace 606 and left brace 608 are parallel support members 610. Intermediate forms 613 are connected to or otherwise integral with angled forms 611. A central brace 612 is also provided, positioned intermediate the rear brace 604 and a front brace 614. The front brace 614 includes a left portion 624 and a right portion 626. The handle 616 includes a rear handle brace 618 extends parallel to the rear brace 604 and the central brace 612. Seven of the intermediate support members 610 have one end of each of the same interconnected to the rear handle brace 618. Also, each opposing end of the rear handle brace 618 is interconnected to one of the support members 610, again as illustrated in FIG. 11.

In addition to the foregoing, the oven rack 602 includes a front brace 614. The front brace 614, with reference to FIG. 11, includes the left portion 624 and right portion 626. The front brace 614 provides a forward bracing means for the oven rack 602. Three of the support members 610 are interconnected to the left portion 624 of the front handle brace 614, while three others of the members 610 are interconnected to the right portion 626 of the front handle brace 614. The handle 616 includes the rear handle brace 618 as previously described herein. Also, the handle 616 includes a front handle brace 620. The front handle brace 620, as illustrated in FIGS. 11 and 12, is elongated and positioned in a manner so as to have a curved configuration. If desired, the front handle brace 620 can actually be a brace which is integral with the front brace 314 comprising the left portion 624 and the right portion 626.

With the handle rack 300 illustrated in FIGS. 5 and 6, the front handle brace 320 of the handle rack 300 is angled downwardly. In contrast, with the handle rack 600, the front handle brace 620 of the handle 616 is not angled downwardly, and is essentially on the same horizontal plane as the main body of the oven rack 602.

Figure 13:
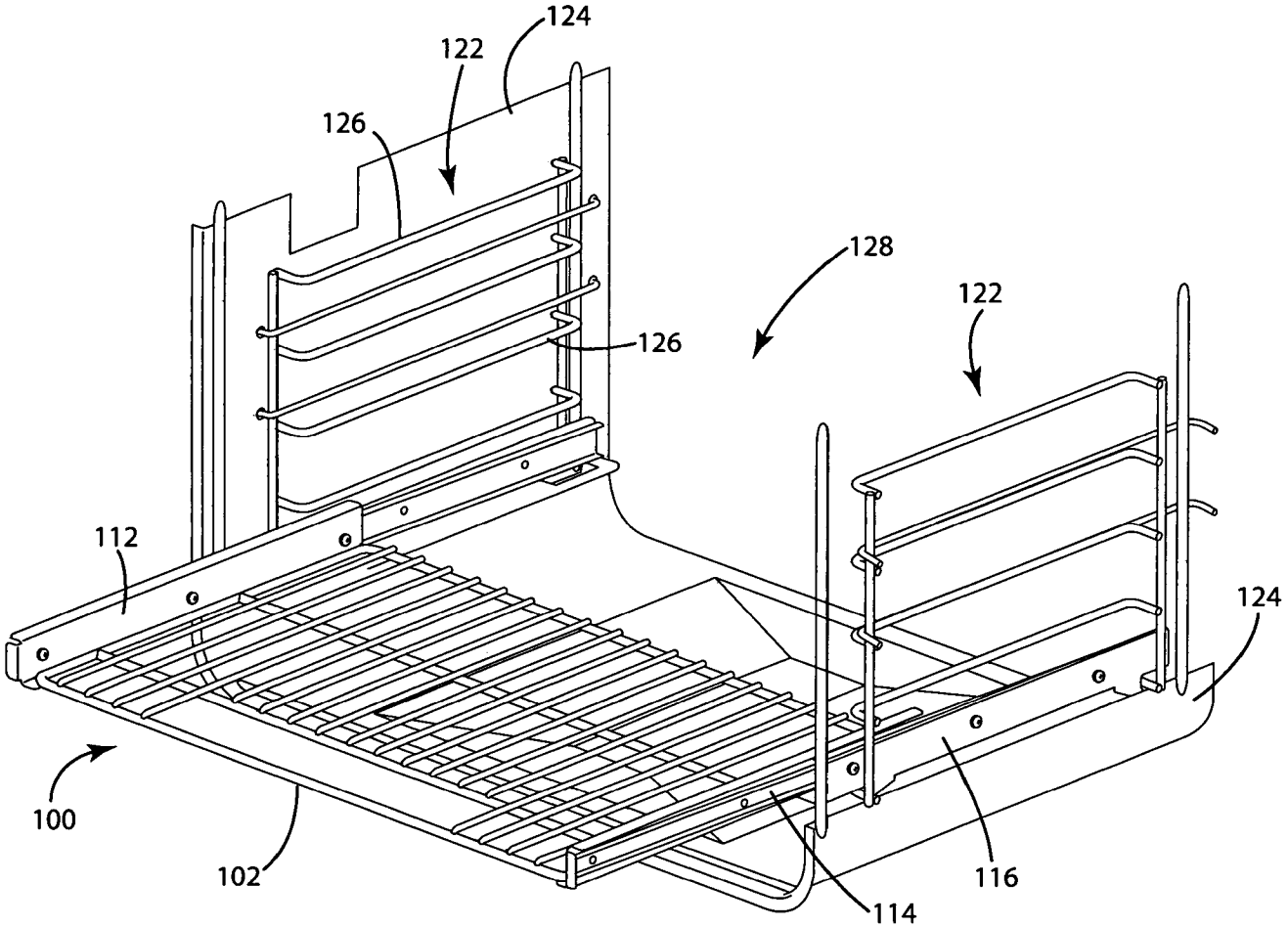
FIG. 13 is a perspective view of a further embodiment of an oven rack assembly, showing an oven interior with ladder frames.
Figure 14:
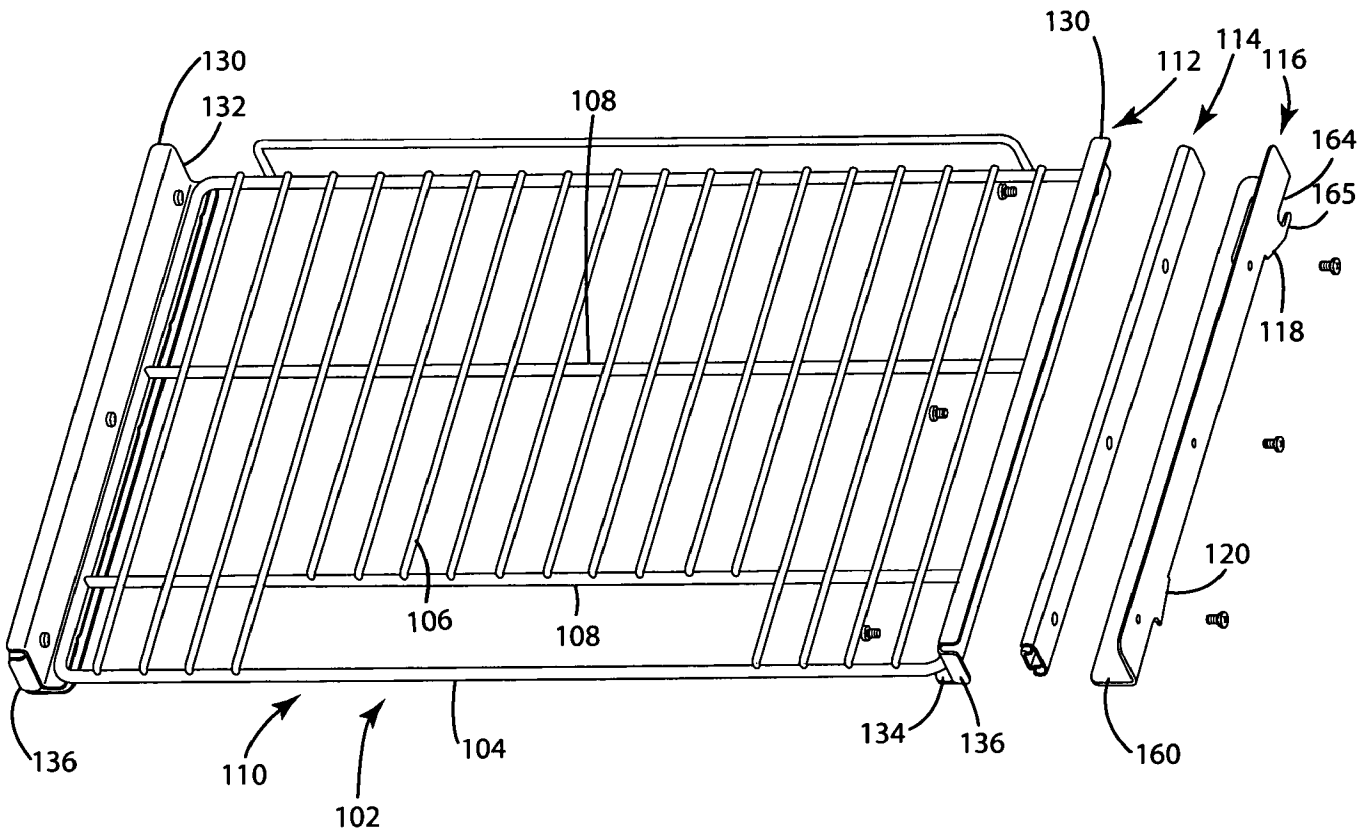
FIG. 14 is an exploded view of the oven rack assembly illustrated in FIG. 13.

The extension oven rack assembly 100', will now be described with respect to FIGS. 13-18. Turning to FIG. 13, the oven rack 100' assembly is utilized within an oven 128', having oven interior surfaces 124'. Mounted in any suitable manner to the sides of the oven interior surfaces 124' are a pair of ladder frames 122'. As shown in FIG. 13, each of the ladder frames 122' includes a series of parallel and horizontally positioned rack position tracks 126'. The ladder frames 122' are conventional in nature. As illustrated in FIG. 14 in an exploded format, the oven rack assembly 100' includes an oven rack 102'. The oven rack 102' includes a formed wire which comprises a continuous outer frame wire 104' for the oven rack 102'. The outer frame wire 104' forms the front, sides and rear of the surface area of the oven rack 102'. The oven rack 102' also includes a series of parallel and spaced apart transverse wires 106'. The surface of the oven rack 102' is also formed by a set of parallel and spaced apart cross wires 108'. The cross wires 108' may be preferably welded to the sides of the outer frame 104'. Correspondingly, the transverse wires 106' may be welded or otherwise secured to the front and rear portions of the outer frame 104', and also to intersecting transverse wires 106'. If desired, a handle 110' can be formed at the front portion of the oven rack 102'

Figure 18:
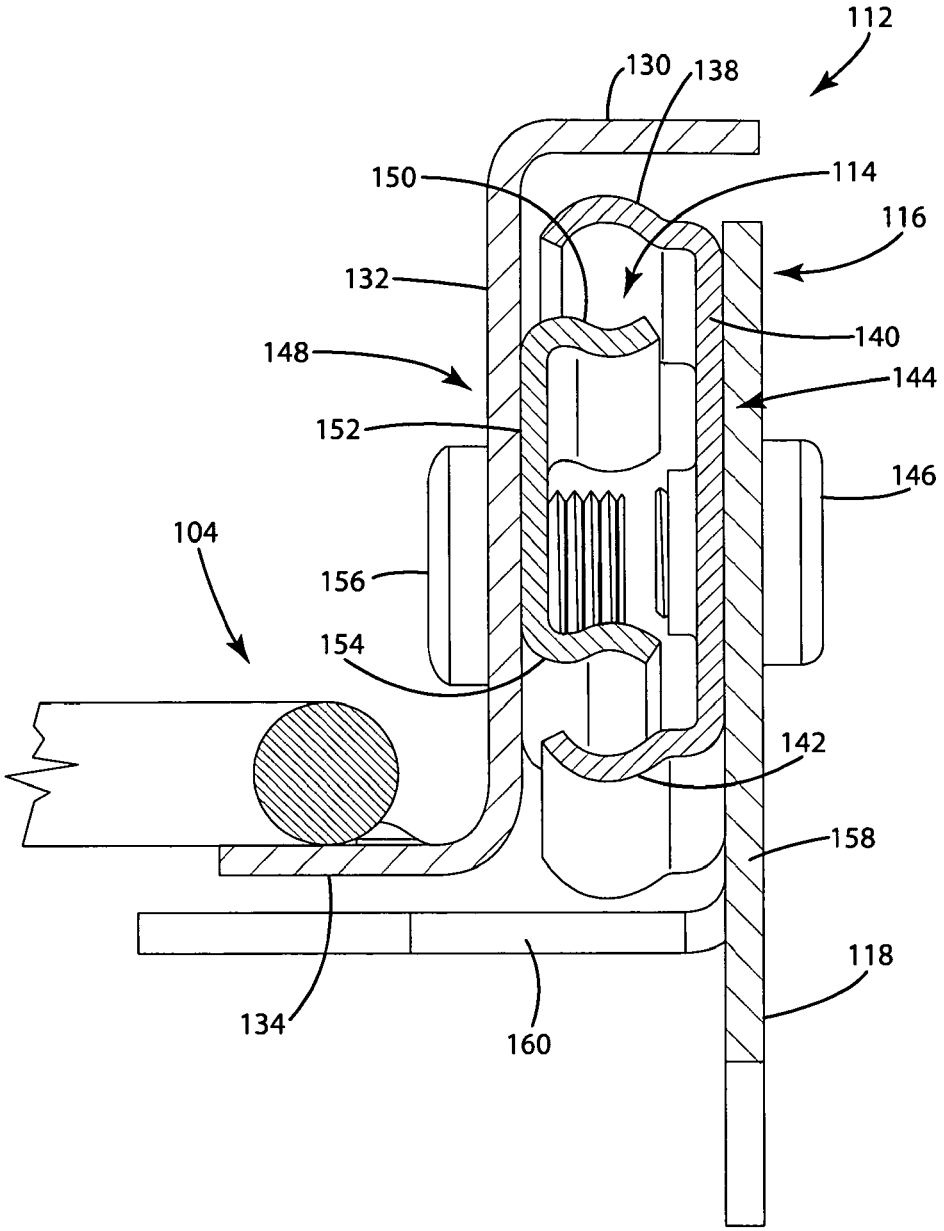
FIG. 18 is a cross section of the oven rack assembly illustrated in FIG. 13, in accordance with the invention.

With reference primarily to FIGS. 14 and 18, the oven rack assembly 100' further includes a Z-shaped support stamping 112'. The stamping 112' includes a horizontally disposed top portion 130', vertically disposed side portion 132' and horizontally disposed lower portion 134'. These elements are primarily shown in FIG. 18. As shown in FIG. 14, the support stamping 112' may also include a front face portion 136. The support stamping 112', as primarily illustrated in FIG. 18, is preferably welded to the outer frame 104' of the oven rack 102'. In FIG. 18, the lower portion 134 of the support stamping 112' is shown as being welded to the frame 104'. In this manner, when the oven rack 102' is moved between retracted and extended positions, the support stamping 112' will move in unison with the rack 102'. The support stamping 112' provides support for the oven rack. In this manner, the support stamping 112' removes the need for any type of subframe, as required in prior art systems.

Still further, the oven rack assembly 100' includes a ball bearing slide 114'. The ball bearing slide 114' is also primarily illustrated in FIGS. 14 and 18. The ball bearing slide 114', as primarily shown in FIG. 18, includes an upper portion 138, side portion 140 and lower portion 142. This portion of the ball bearing slide 114' forms an outer bracket 144 which is secured to an L-shaped connection stamping 116' described in subsequent paragraphs herein. The connection can be made through screws 146 or similar connection means. Still further, the ball bearing slide 114', as with conventional slides, includes an inner, slidable bracket 148. The bracket 148 includes an upper portion 150, side portion 152 and lower portion 154. This inner bracket 148 is secured to the Z-shaped support stamping 112', through the use of screws 156 or similar connecting means.

Again primarily with respect to FIGS. 14 and 18, the oven rack assembly 100' includes the L-shaped connection stamping 116'. The L-shaped connection stamping 116' includes a vertically disposed side section 158' and an integral, horizontally disposed lower section 160'. The lower section 160' turns inwardly toward the oven rack 102', relative to the side section 158'. As earlier described, the side section 158' is secured to the outer bracket 144' of the ball bearing slide 114'. As also earlier described, this connection can be made by the use of screws 146' or similar connection means.

Figure 15:
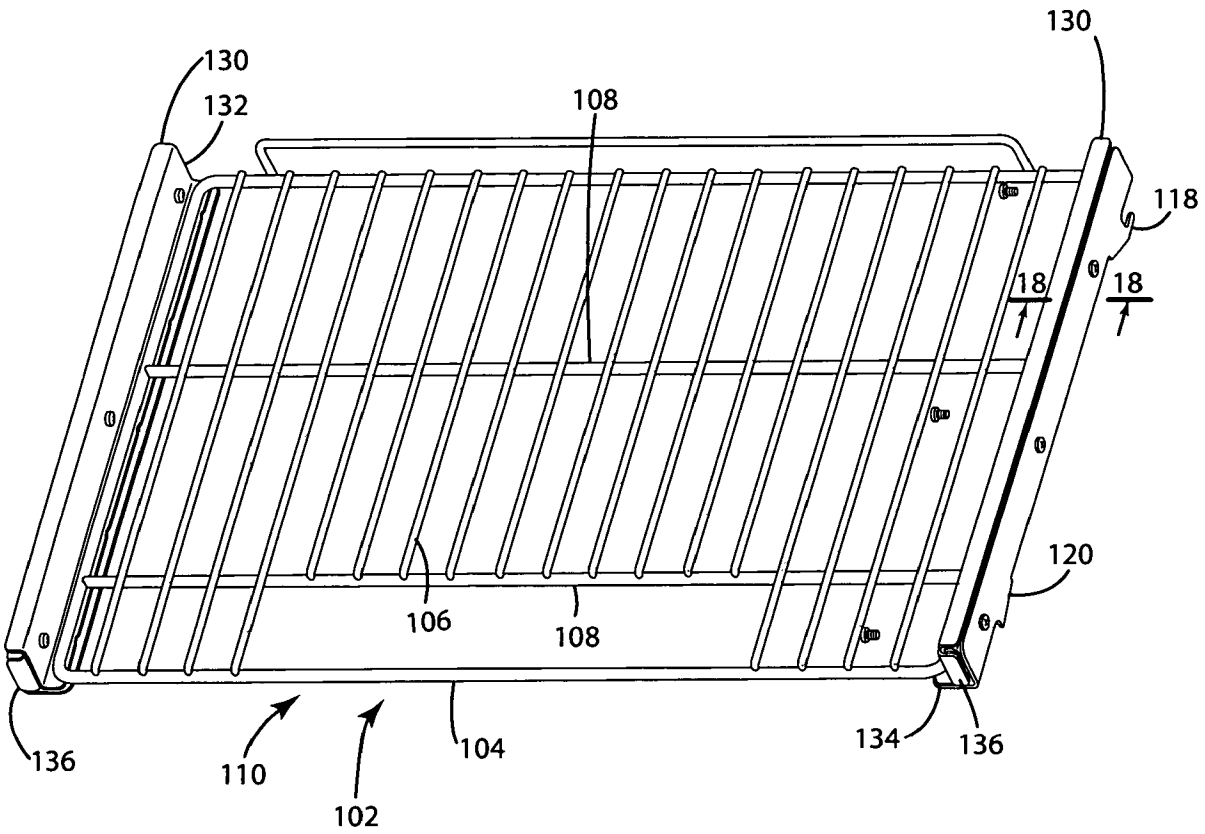
FIG. 15 is a perspective view of the oven rack assembly illustrated in FIG. 14, showing the oven rack assembly in an assembled state.

The L-shaped connection stamping 116' also includes a pair of catches 118', 120'. More specifically, the connection stamping 116' includes a rear tab catch 118' which is integral with the side section 158 and depends downwardly therefrom. As shown in FIGS. 14 and 15, the rear tab catch 118' includes a rearwardly extending finger 162'. The finger 162' acts so as to form a slot 164'. As described in subsequent paragraphs herein, the slot 164' is utilized to capture a rack position track 126' during use of the oven rack assembly 100'. The catches 118', 120' also include a front stamped tab catch 120'. As with the rear stamped tab catch 118', the front catch 120' depends downwardly from and is integral with the side section 158' of the connection stamping 116'. As apparent from the drawings, particularly FIGS. 13, 14 and 15, the support stamping 112', bearing slide 114' and connection stamping 116' are appropriately positioned on each side of the oven rack 102', and coupled to each side of the oven interior surfaces 124' through the rack position tracks 126'. It is apparent from the foregoing that the connection stamping 116', through the tab catches 118', 120', provides a connection means between the oven rack 102' and the rack position tracks 126'.

In operation, the pair of connection stampings 116' can be coupled to desired rack position tracks 126' (at a particular desired height) through the use of tabs 118', 120'. More specifically, the slot 164' of each of the rear tabs 118' is utilized to capture opposing rack position tracks 126'. As shown in both FIGS. 16 and 17, the front tab catch 120' is positioned relative to the rack position tracks 126' so as to prevent any forward movement of the connection stamping 116'. It is also apparent that when a user wishes to move the connection stamping 116' and associated oven rack assembly 100' to a different set of tracks 126', the front portion of the connection stamping 116' can be rotated upwardly, so that the front tab catch 120' is removed from horizontal alignment with the rack position track 126'. The rack position track 126', at its rear portion, can then be removed from capture by the slot 164 of the rear tab catch 118', thereby removing the connection stamping 116' from the particularly rack position track 126'.

Figure 16:
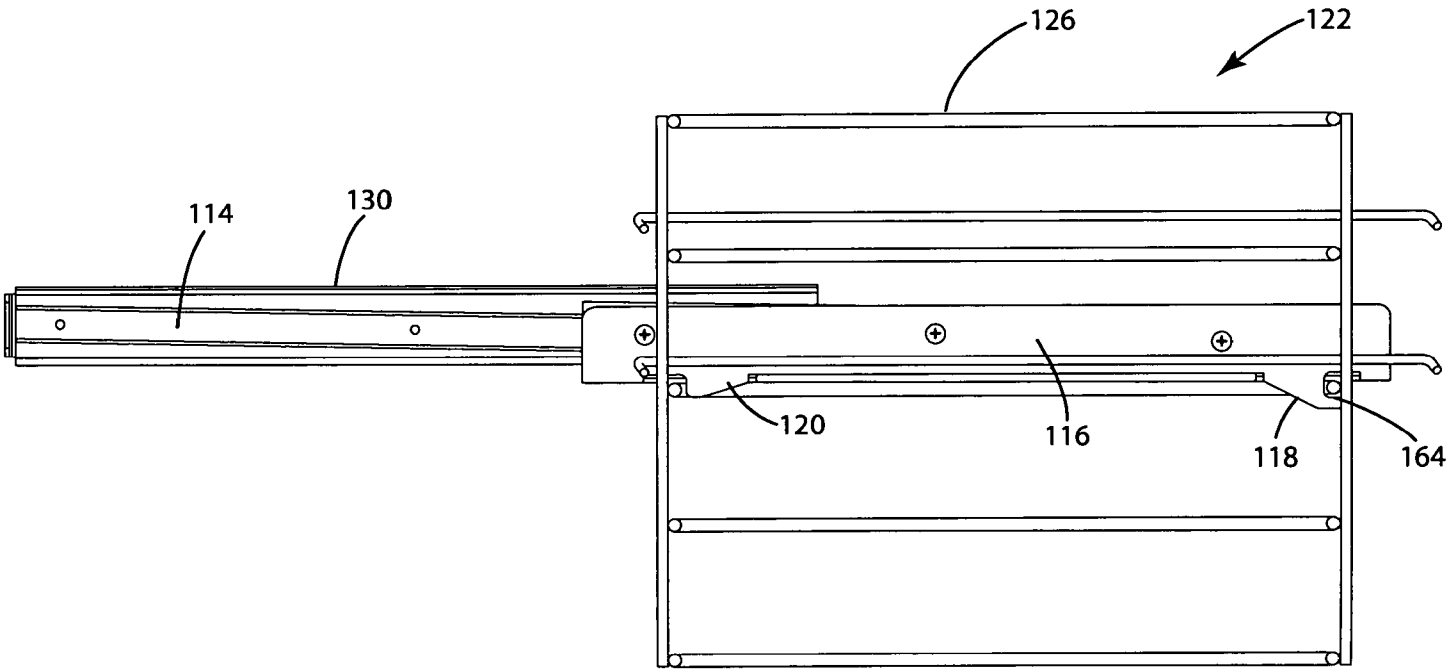
FIG. 16 is a side view of the oven rack assembly illustrated in FIG. 15, showing the oven rack in an extended state.
Figure 17:
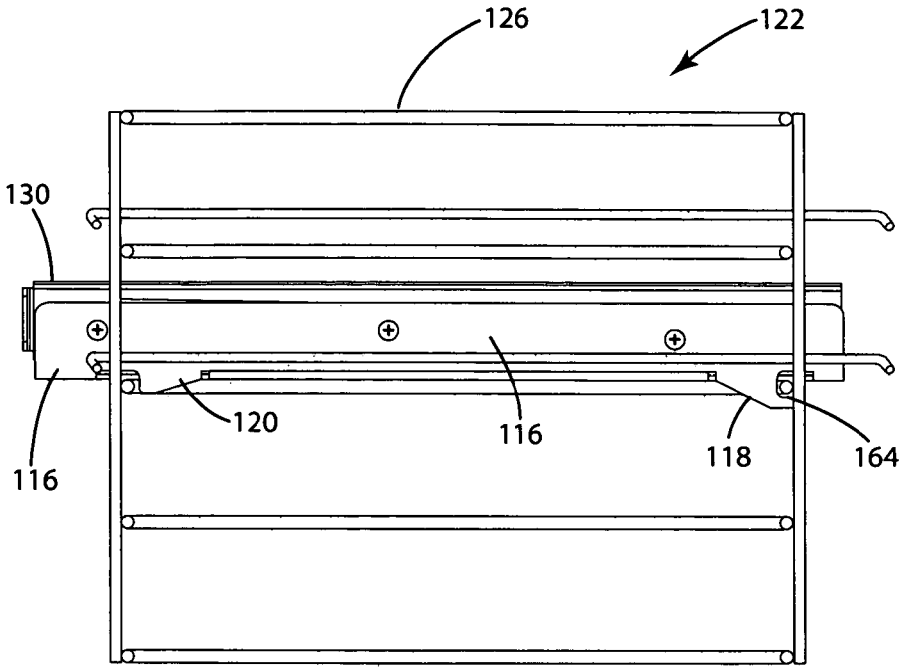
FIG. 17 is a side view of the oven rack assembly illustrated in FIG. 15, but showing the rack assembly in an unextended or retracted state.

FIG. 17 illustrates the oven rack assembly 100' in a retracted or unextended position. When it is desired to extend the oven rack 102' of the oven rack assembly 100', the user can exert forwardly directed forces (through the handle 110') on the oven rack 102'. The ball bearing slide 114' will then act so as to move forwardly relative to the connection stamping 116'. With the inner bracket 148' of the ball bearing slide 116' being coupled to the oven rack 102', this part of the ball bearing slide 114' and the oven rack 102' will move forwardly, in unison, to an extended position. Dependent upon the particular type of ball bearing slide utilized, the oven rack 102' can be permitted to move to a fully extended position (such as shown in FIG. 16), or can be limited to forward movement only to a partially extended position (not shown).

When it is desired to retract the oven rack 102', the user can exert rearwardly directed forces on the oven rack 102', and the oven rack 102' and inner bracket 144' of the ball bearing slide 114' will then move back to retracted position, as illustrated in FIG. 17.

Although the oven rack assembly 100' is shown in use with a ladder frame application in FIGS. 13-18, it is apparent that an oven rack assembly may also be utilized with ribbed liners or the like. As further apparent from the description of the oven rack assembly 100', the assembly 100' utilizes two different metal stampings, which provide support and act as a connection means between the oven rack and the ladder tracks. One stamping, namely the support stamping 112', may be welded or otherwise secured to the oven rack 102'. The other stamping, namely the connection stamping 116', provides a connection means (through the use of the tab catches 118', 120') between the oven rack 102' and the ladder tracks 126'. Also, as earlier stated, ball bearing slides 114' may be utilized, and may be of either a "full extension" or "partial extension" type. The ball bearing slides 114' are attached between the support stamping 112' and the connection stamping 116' to complete the oven rack assembly 100'.

Still further, the oven rack assemblies may utilize a porcelain coating, thereby allowing the oven rack assemblies to be left within the oven during self clean cycles. Also, other types of coatings may also be utilized, such as nickel or chrome plating.

The oven rack assembly 1000, in accordance with the invention, will now be described with respect to FIGS. 19-24. A number of components of known oven rack assemblies and related oven elements have been previously described herein with respect to the handle rack 100 and oven rack assembly 100'. Accordingly, such elements will not be described in any substantial detail in subsequent paragraphs herein with respect to the oven rack assembly 1000 or other oven rack assemblies in accordance with the invention.

Figure 19:
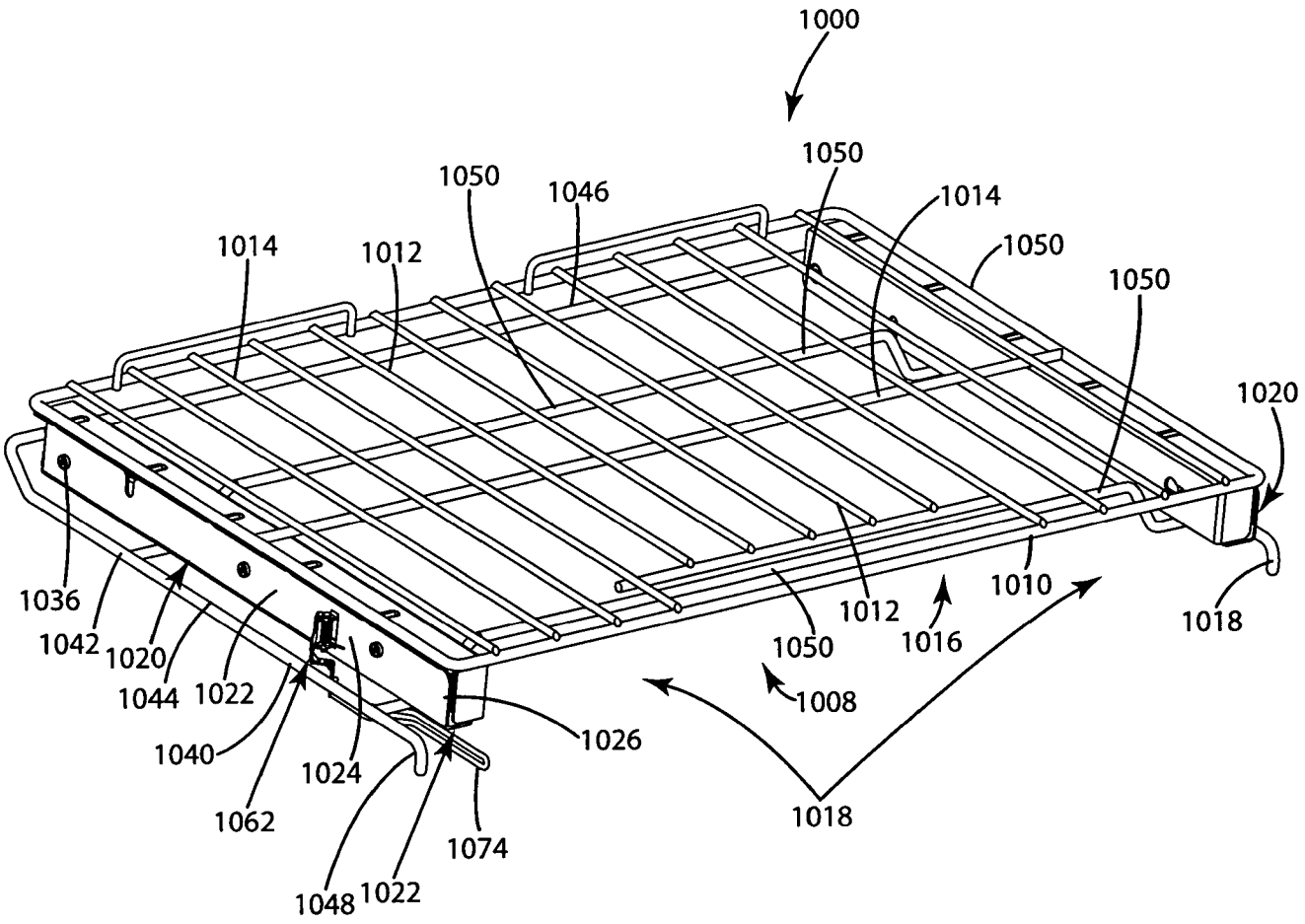
FIG. 19 is a perspective view of an oven rack assembly having a release mechanism in accordance with the invention.
Figure 23:
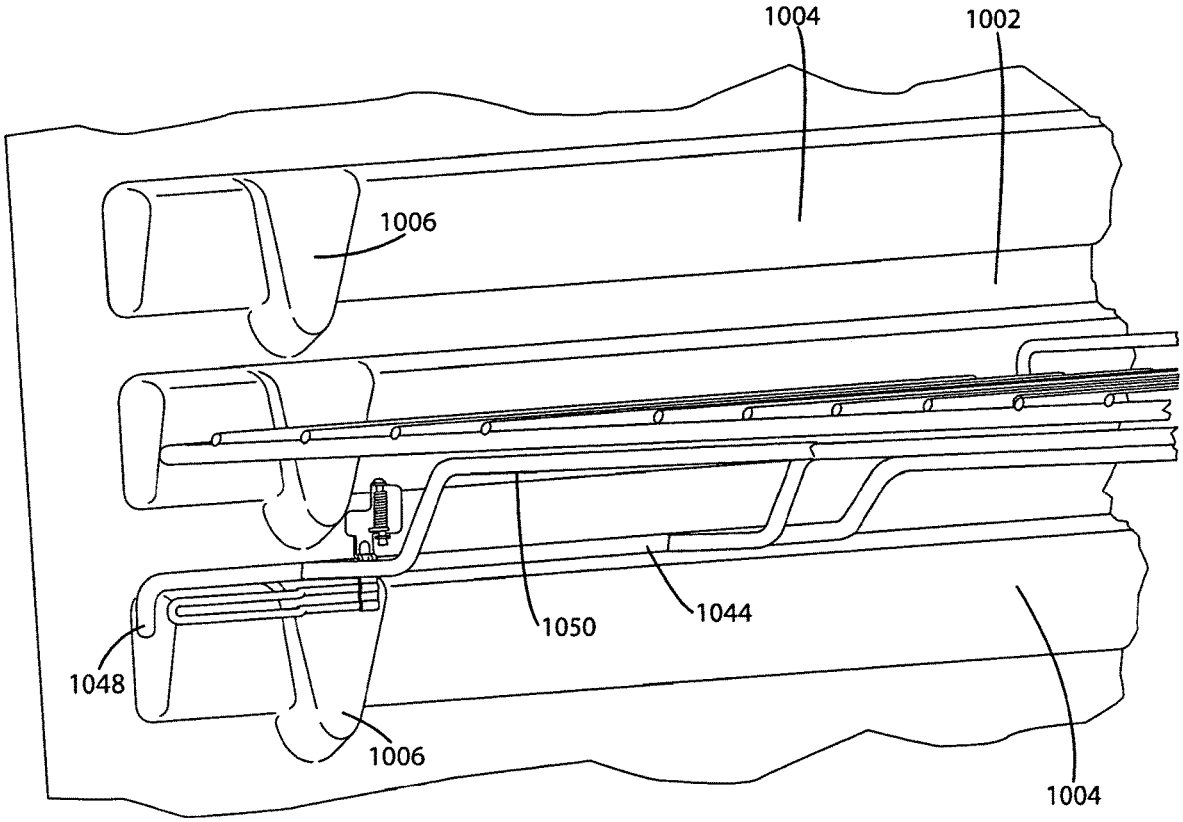
FIG. 23 is a view showing the relationship of the subframe and release mechanism of the oven rack assembly to the ribs of the oven liner, when the oven rack assembly is releasably coupled to the oven liner.
Figure 24:
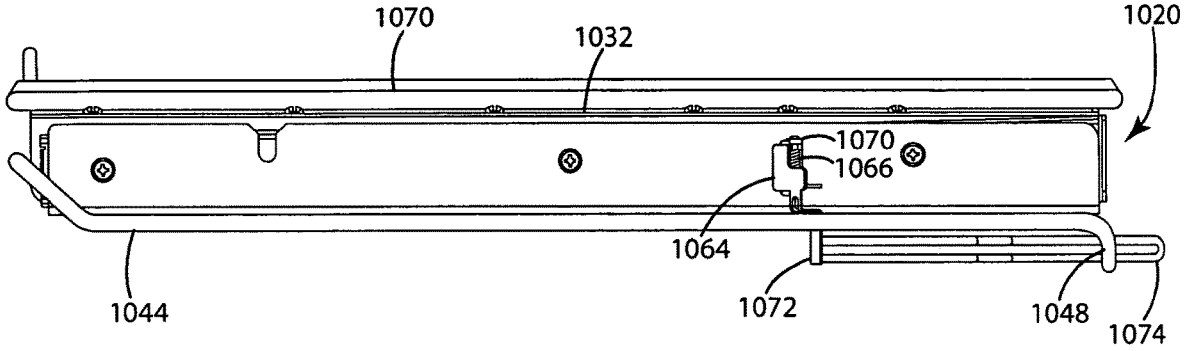
FIG. 24 is a side, elevation view similar to FIG. 21, but showing the entirety of one side of the oven rack assembly in accordance with the invention.

Turning first to FIG. 19, the oven rack assembly 1000 can be used within a conventional oven, such as the oven 128' previously described herein with respect to the oven rack assembly 100'. The oven 128' can include oven interior surfaces, such as the oven interior side surface 1002 shown in FIG. 23. Integral with or otherwise mounted in any suitable manner to the side oven interior surface 1002 are a set of liner ribs 1004 projecting therefrom, as also shown in FIG. 23. The liner ribs 1004 may be vertically stacked, as further shown in FIG. 23, for purposes of providing the capability of adjusting the height of the oven rack assembly 1000 within the oven 128'. As still further shown in FIG. 23, each of the liner ribs 1004 may be configured so as to provide for a downwardly extending nodule 1006. As will be described in subsequent paragraphs herein, and in accordance with the invention, the nodules 1006 act in cooperation with release mechanisms (subsequently described herein) so as to maintain the oven rack assembly 1000 in a stationary state, until a user wishes to remove the rack from the oven 128'.

With reference back to FIG. 19, the oven rack assembly 1000 includes an oven rack 1008. The oven rack 1008 includes a formed wire which comprises a continuous outer wire frame 1010. The outer wire frame 1010 forms a front, sides and rear of the surface area of the oven rack 1008. The oven rack 1008 also includes a series of parallel and spaced apart transverse wires 1012. The surface of the oven rack 1008 is also formed by a set of parallel and spaced apart cross wires 1014. The cross wires 1014 may be preferably welded to the sides of the outer wire frame 1010. Correspondingly, the transverse wires 1012 may be welded or otherwise secured to the front and rear portions of the outer frame 1010, and also to intersecting transverse wires 1012. If desired, a handle 1016 can be formed at the front portion of the oven rack 1008.

Figure 20:
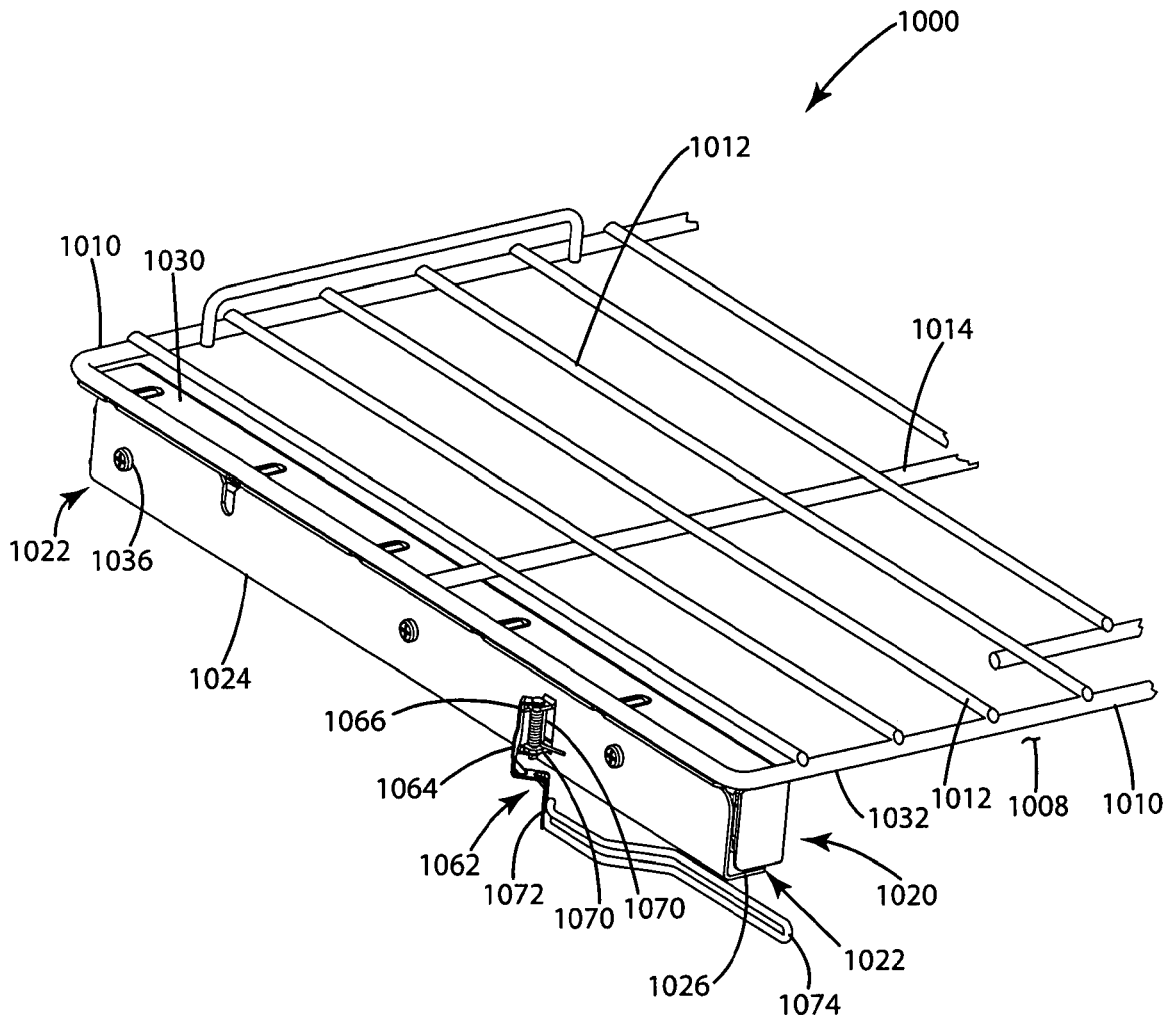
FIG. 20 is a perspective and close up view illustrating the oven rack assembly shown in FIG. 19, but with FIG. 20 only showing one side of the assembly, and with FIG. 20 showing elements of the oven rack assembly absent the subframe.
Figure 22:
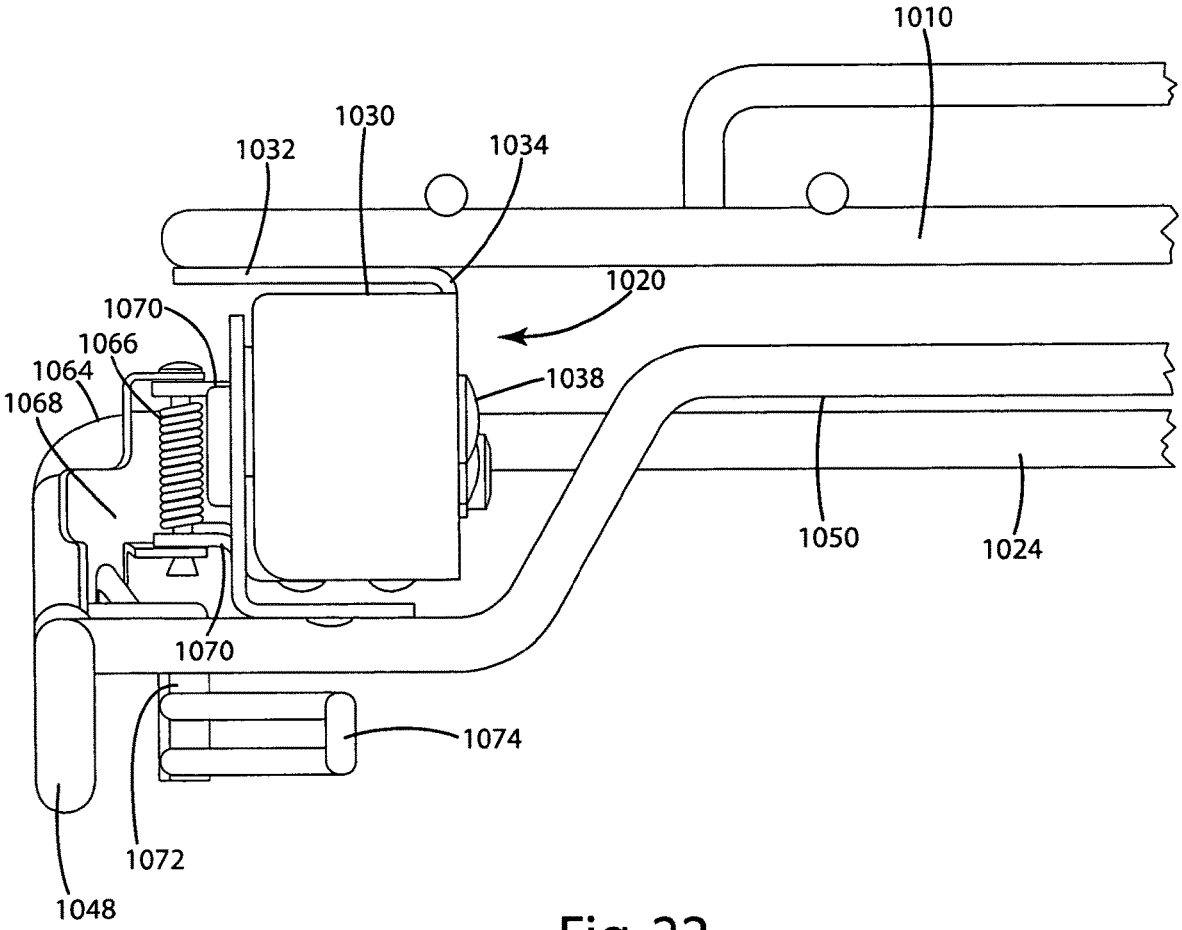
FIG. 22 is a front elevation view in relative close up showing the release mechanism of one side of the oven rack assembly, and its positioning relative to the slide system.

Still further, the oven rack assembly 1000 includes a slide system 1018. With reference primarily to FIGS. 19, 20 and 22, the slide system 1018 includes a pair of slide devices 1020 positioned at opposing sides of the oven rack 1008 as primarily illustrated in FIG. 19. Each of the slide devices 1020 includes an L-shaped outer side stamping 1022. Each side stamping 1022 includes a vertically disposed side portion 1024 and a lower horizontally disposed portion 1026 (primarily shown in FIGS. 20 and 22). In addition to the outer side stamping 1022, each of the slide devices 1020 also includes a ball bearing slide 1028, which is only slightly visible in FIGS. 20 and 22. The ball bearing slide 1028 can be substantially similar to the ball bearing slide 114' previously described in detail herein, and illustrated in FIG. 18. The ball bearing slide 1028 can be coupled in part to the side portion 1024 of the outer side stamping 1022 through the use of screws 1036, which could also be rivets or the like.

Each of the slide devices 1020 further includes an inner L-shaped stamping 1030, shown in part primarily in FIGS. 20 and 22. Each of the inner L-shaped stampings 1030 can include a top horizontal portion 1032 and a vertically extending side portion 1034. One of the side portions 1034 is partially visible in FIGS. 20 and 22. Certain elements of the ball bearing slide 1028 can be coupled to the vertical side portion 1034 of the inner stamping 1030 through the use of screws 1038, which could also be rivets or the like. Again, the details of the ball bearing slide 1028 can substantially correspond to those previously described herein with respect to the ball bearing slide 114' illustrated in FIG. 18.

In addition to the aforedescribed elements, the oven rack assembly 1000 also includes a subframe 1040. The subframe 1040 and portions thereof are primarily shown in FIGS. 19 and 21-24. More specifically, the subframe 1040 is primarily formed as a three-sided rectangle with an outer wire frame 1042. The outer wire frame 1042 includes a pair of opposing side portions 1044 and a rear portion 1046 integral therewith. At the forwardmost sections of the side portions 1044, a pair of front and downwardly depending hooks 1048 are formed. In addition, the subframe 1040 also includes a pair of cross-bars 1050 extending transversely between the opposing side portions 1044 of the frame 1042. The cross-bars 1050 provide rigidity and support for the subframe, and may be welded or otherwise connected to the side portions 1044. When the oven rack assembly 1000 is positioned in place within the oven, each of the side portions 1044 of the wire frame 1042 is supported on the top of a liner rib 1004. The relationship between one of the side portions 1044 and one of the liner ribs 1004 is shown in detail in FIG. 23. With this configuration, it is apparent from FIG. 23 that the downwardly depending front hooks 1048 of the side portions 1044 are positioned at the front ends of the liner ribs 1004. Still further, the subframe 1040 can be securely connected to the slide system 1018 through weldments or other securing means connecting the cross-bars 1050 to the lower horizontal portions 1026 of the outer side stampings 1022. With these couplings between the subframe 1040 and the slide system 1018, and the oven rack 1008 and the slide system 1018, the oven rack 1008 can be extended and retracted through operation of the ball bearing slides 1028, with the L-shaped outer side stampings 1022 and the subframe 1040 remaining in place.

In addition to the aforedescribed elements of the oven rack assembly 1000, and in accordance with the invention, the oven rack assembly 1000 further includes a retention/release assembly 1060 which provides means for facilitating retention of the position of the subframe 1040 on the liner ribs 1004, and also facilitating release of the subframe 1040 from the liner ribs 1004, when a user wishes to remove the subframe from the oven. The retention/release assembly 1060 includes a pair of retention/release devices 1062, one of which is mounted on each of the opposing sides of the oven rack assembly 1000. Because the retention/release devices 1062 are substantially identical and basically comprise "mirror" images of each other, only one of the retention/release devices 1062 is shown in most of the drawings, and only one will be described herein.

Still further, with respect to the retention/release devices 1062, the disclosure herein describes (and the drawings illustrate) one embodiment of the devices 1062. In this particular embodiment, each of the retention/release devices 1062 includes a retention spring 1066, as described in subsequent paragraphs herein. As also further described herein, each of the retention/release devices 1062 is mounted to the subframe 1040. The use of the retention springs 1066 and the mounting of the devices 1062 to the subframe 1040 are being particularly noted prior to detailed disclosure of the same herein, because of their respective relationships to the principal concepts of the invention. That is, although the devices 1062 are shown with the retention springs 1066, retention/release devices functioning in accordance with the invention do not necessarily require the retention springs 1066. Instead, the function performed by the retention springs 1066 could be achieved through the use of similar types of elements mounted elsewhere on the oven rack assembly 1000, or the spring function can be eliminated entirely. More specifically, and as described in greater detail herein, each of the retention/release devices 1062 is mounted or otherwise connected to elements of the subframe 1040. It is this relationship between the retention/release devices 1062 and the subframe 1040 which forms a principal concept of the invention.

Figure 21:
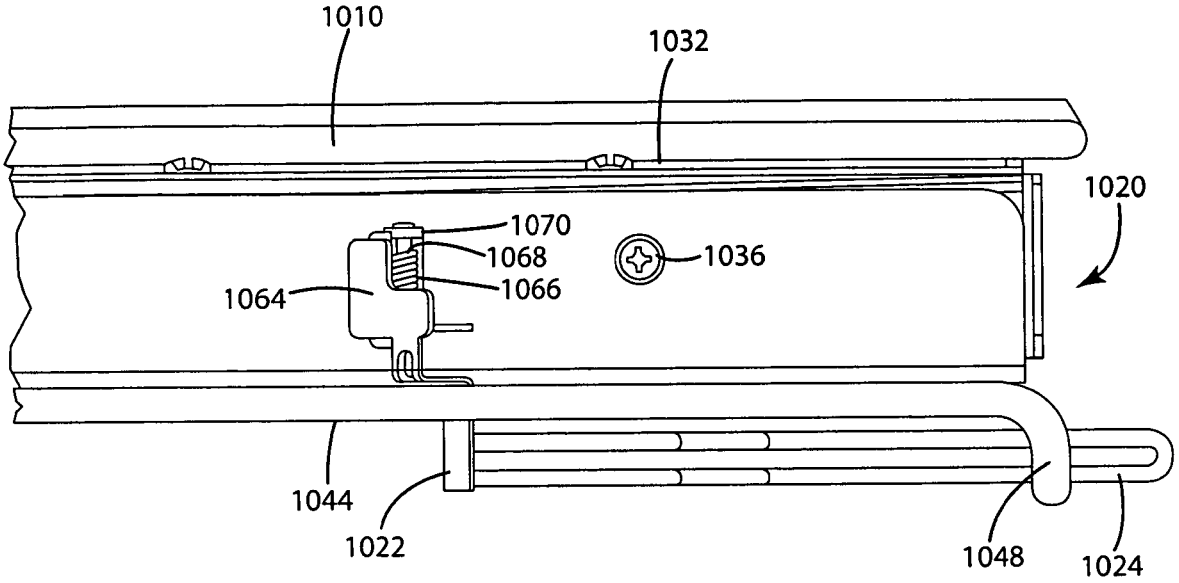
FIG. 21 is a partial, elevation view of the oven rack assembly illustrated in FIG. 19, showing relatively greater detail with respect to the release mechanism.

More specifically, and primarily with reference to FIGS. 20-24, each of the retention/release devices 1062 may include a retainer tab 1064 having a vertically disposed configuration and a shape as primarily shown in FIGS. 20, 21 and 22. As described subsequently herein, the retainer tab 1064 on each of the retention/release devices 1062 operates so as to provide a means for retaining the subframe 1040 in a particular stationary position, relative to the liner ribs 1004. Each retainer tab 1064 is at least partially rotatable, and may be coupled to a vertically disposed retention spring 1066. The retention spring 1066, in turn, is mounted in any suitable manner to the outer surface of a vertically disposed axle 1068. In turn, the axle 1068 is rotatably mounted to a bracket 1070 having bracket arms with apertures therethrough, so as to rotatably receive the axle 1068. The bracket 1070 is rigidly secured to the side portion 1024 of the corresponding L-shaped outer side stamping 1022 of the slide device 1020.

Still further, each of the retention/release devices 1062 may include a lever bracket 1072 integral with or otherwise coupled to its corresponding retainer tab 1064. As shown primarily in FIGS. 20-22, the lever bracket 1072 depends partially downwardly and is connected in any suitable manner to a lever 1074 operable by a user and having the configuration shown particularly in FIG. 20.

In operation, when there are no forces externally exerted on the lever 1074, the relative position of the retention spring 1066 and retainer tab 1064 will be one which causes the retainer tab 1064 to be directed laterally, as shown in both FIGS. 20 and 22. However, if the user exerts forces on the lever 1074 so as to cause the lever 1074 to move inwardly (i.e. toward the center of the oven rack 1008), the action of lever 1074 through the lever bracket 1072 will exert rotational forces on the retainer tab 1064. The coupling of the retainer tab 1064 to the retention spring 1066, and the capability of the retention spring 1066 to rotate on the axle 1068, will cause the retainer tab 1064 to rotate so that the tab is no longer projecting directly and laterally outwardly from the corresponding side portion 1024 of the outer side stamping 1022.

With respect to operation of the retention/release assembly 1060 and its interaction with the liner ribs 1004, reference is made primarily to FIGS. 19 and 23. When the subframe 1040 is positioned within the oven, the retainer tab 1064 on each side of the oven rack assembly 1000 will be positioned as primarily shown in FIG. 23. That is, the retainer tab 1064 will essentially abut one of the nodules 1006 associated with a corresponding one of the liner ribs 1004. That is, the retainer tab 1064 will be extended outwardly, and no forces are exerted on the lever 1074. When it is desired to remove the subframe from the oven, the user can exert inwardly directed forces on both of the retention/release devices 1062 associated with the oven rack assembly 1000. As earlier described, such exertion of forces will result in the retainer tabs 1064 being rotated away from their outwardly projecting configuration. When the retainer tabs 1064 have been rotated, the tabs 1064 are freed from abutment with the corresponding liner ribs 1004. The subframe 1040 can then be pulled forwardly for purposes of removal from the oven. It should be noted that with the interaction of the retainer tab 1064 and the retention spring 1066 of each device 1062, the retainer tab 1064 may move back into a configuration where it projects laterally outwardly, after external forces have been removed from the corresponding lever 1074. Also, as earlier described herein, the desired functional operation of the retention/release assembly 1060 may be achieved without the necessity of the retention springs 1066 or any elements functionally equivalent thereto. Still further, it is apparent from the forgoing description that when it is desired to place the subframe 1040 on the liner ribs 1004, the user can again exert inwardly directed forces on the levers 1074, so as to cause the retainer tabs 1064 to move away from an outwardly projecting configuration. The subframe 1040 can then be moved into an appropriate position and desired height within the oven, and the user can release the forces exerted on the levers 1074. This release of forces on the levers 1074 will cause the retainer tabs 1064 to again project laterally outwardly, and abut the nodules 1006 of the liner ribs 1004.

Notwithstanding the immediately foregoing description of the operation of the retention/release devices 1062, it should again be emphasized that retention/release devices can be utilized in accordance with the invention in the absence of the retention springs 1066 or other functionally equivalent elements. For example, the foregoing disclosure describes the concept of the retainer tabs 1064 moving "back" into a configuration where they project laterally outwardly, when external forces are removed from the corresponding levers 1074. However, without departing from the principal concepts of the invention, the retention springs 1066 and their associated functions can be removed, and the retainer tables 1064 and corresponding levers 1074 may remain in stationary positions, absent any forces externally applied to the levers 1074. Accordingly, the user would exert forces on the levers 1074 not only when it is desired to removed the subframe from the oven, but also when it is desired to again extend the retainer tabs 1064 laterally outward. Still further, it is apparent from the disclosure herein that devices other than the levers 1074 may be utilized, without departing from the principal concepts of the invention.

Another concept of oven rack assemblies in accordance with the invention is embodied within an oven rack assembly 1200 as illustrated in FIGS. 25-32. In brief summary, the oven rack assembly 1200 in accordance with the invention provides for the use of rearwardly located catches for purposes of supporting a subframe of the assembly 1200, and preventing "tipping" of the assembly 1200 which may result from cantilever forces occurring as a result of the oven rack assembly 1200 being extended. Still further, the use of the rearwardly located catches serves to hold the subframe in place, and facilitates sliding movement of the associated slide devices and oven rack.

Figure 25:
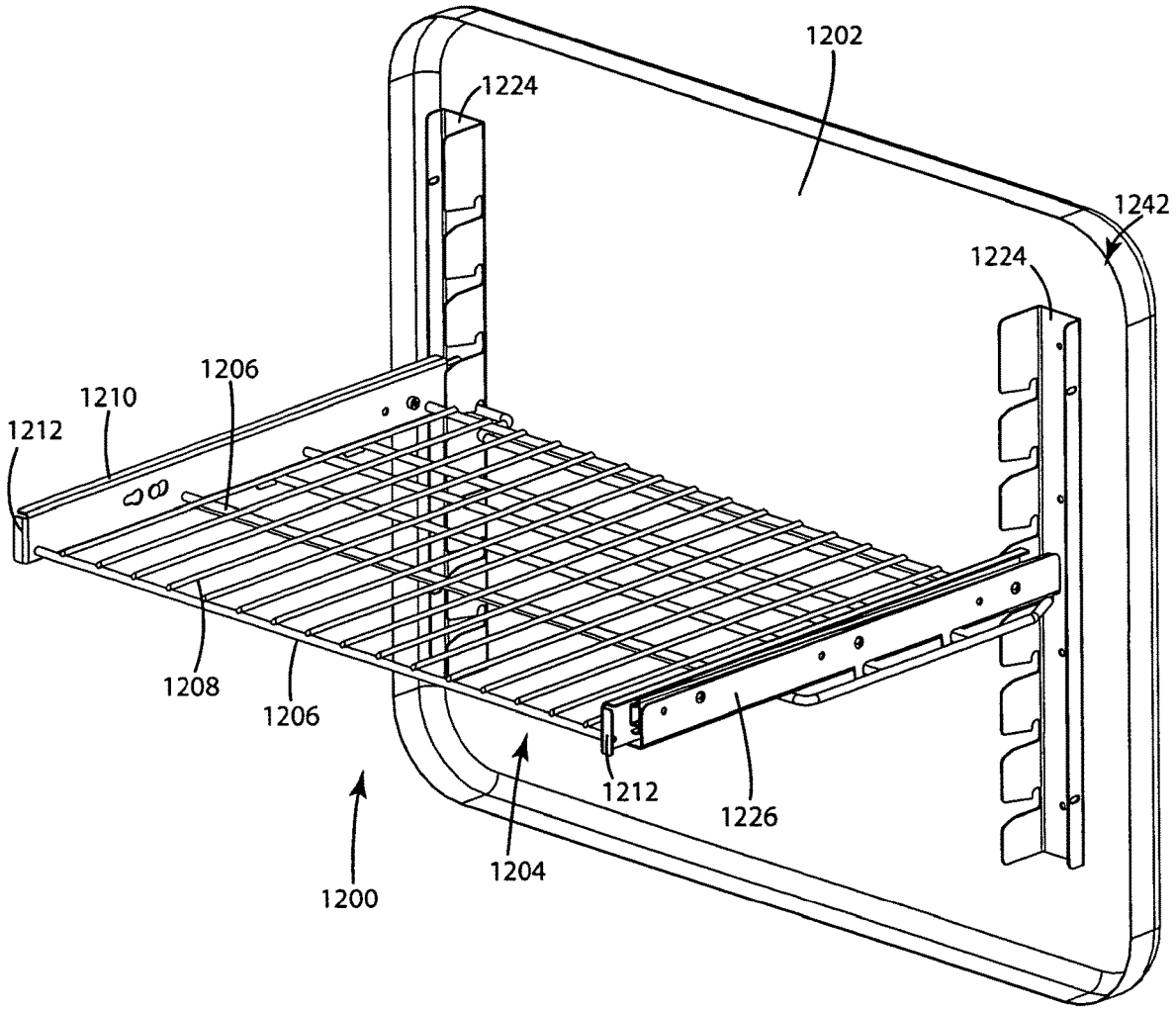
FIG. 25 is a further embodiment of an oven rack assembly in accordance with the invention, showing the coupling of the subframe of the oven rack assembly to rear ladder catches.
Figure 26:
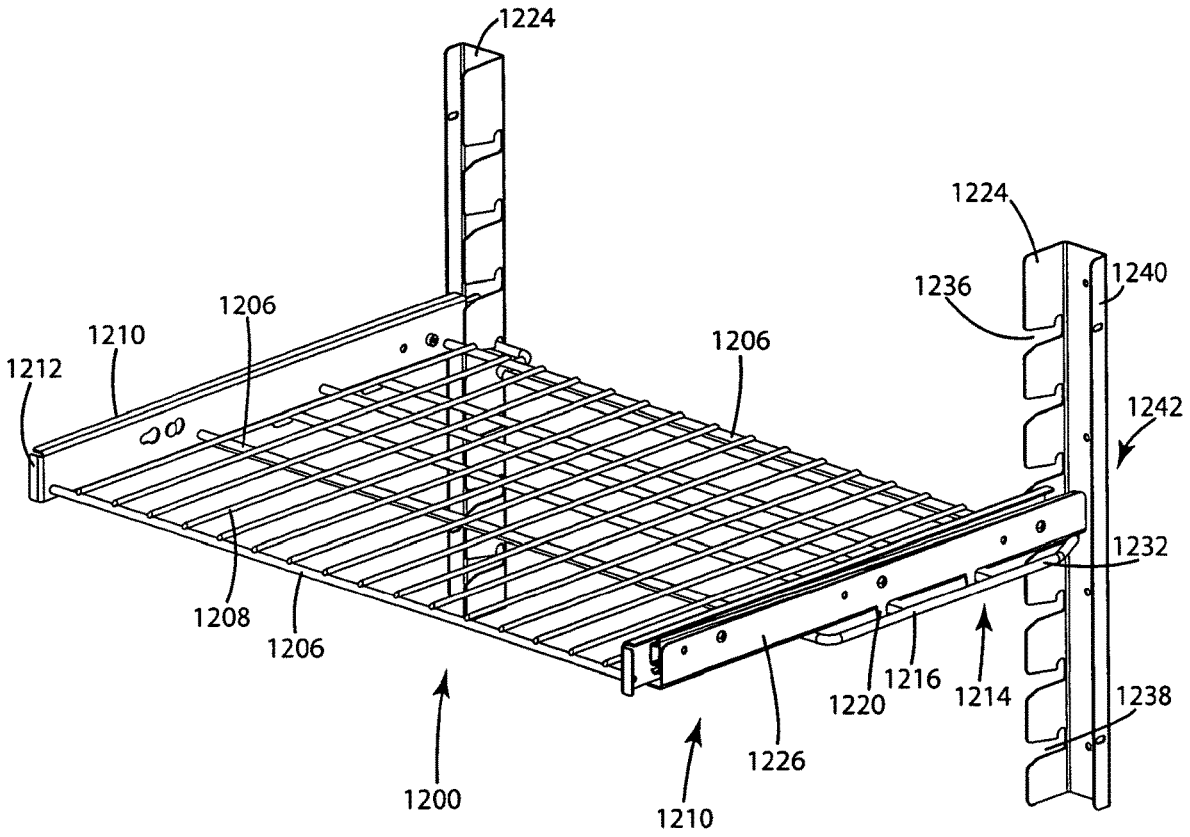
FIG. 26 is a perspective and close up view (relative to FIG. 25) showing the rear ladder catches of FIG. 25 absent the rear wall of the oven liner.
Figure 27:
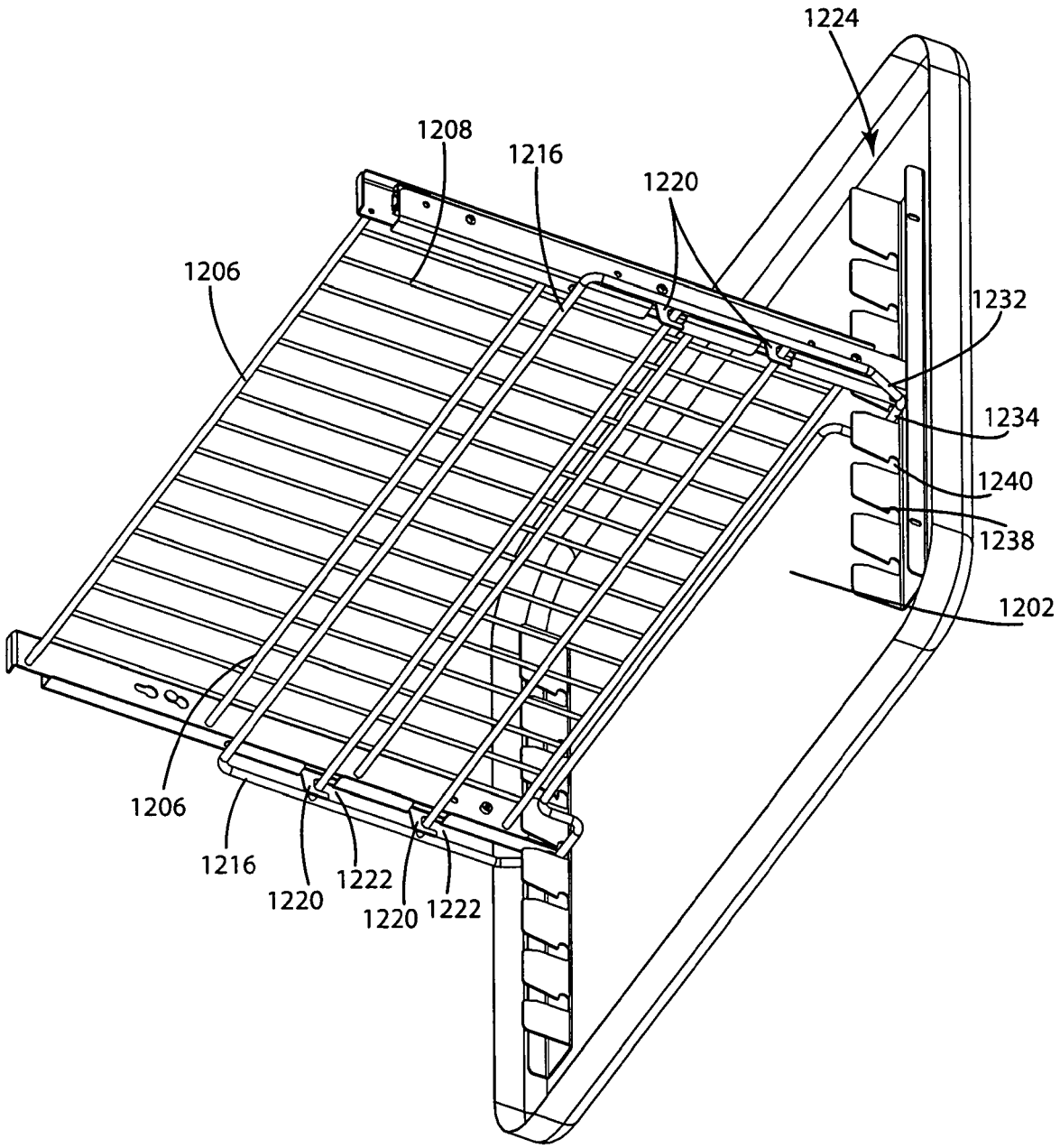
FIG. 27 is an underside, perspective view of the further embodiment of the oven rack assembly in accordance with the invention, showing various elements of the assembly, including the rear ladder catches.

Turning to the drawings, and first with respect primarily to FIGS. 25-29, the oven rack assembly 1200 is supported (as described in greater detail herein) through a pair of ladder catches 1224 vertically mounted on an oven interior rear surface 1202 (FIGS. 25 and 27). At this point in the disclosure, it should be noted that most of the subsequent disclosure herein includes description of the ladder catches 1224 as being mounted to a rear surface of the oven interior. However, without departing from the principal concepts of the invention, the ladder catches can also be mounted to both the rear and the sides of the oven interior, or to only the sides of the oven interior. The oven rack assembly 1200 itself includes a number of components similar to those previously described herein with respect to the oven rack assembly 1000. Such components will not be described in any significant detail in subsequent paragraphs herein. More specifically, the oven rack assembly 1200 can be used with a conventional oven, such as the oven 128' previously described herein with respect to the oven rack assembly 1000 and the oven rack assembly 100'. The oven interior rear surface 1202 comprises an interior surface of the oven. Although not shown in FIGS. 25-32, the oven can also include side surfaces, such as the side oven interior surfaces 1002 previously described herein with respect to the oven rack assembly 1000. Correspondingly, such side oven interior surfaces 1002 can also include sets of liner ribs 1004 projecting therefrom, as shown in FIG. 23 with respect to the oven rack assembly 1000. Further, however, other types of oven side elements can be utilized, in substitution for the liner ribs 1004. Also, and as earlier described herein, side oven interior surfaces 1002 may be utilized to mount ladder catches in accordance with the invention.

The oven rack assembly 1200 includes an oven rack 1204. As shown in the drawings, the oven rack 1204 includes a set of parallel and spaced apart cross wires 1206. Welded to or otherwise connected to the cross wires 1206 are a set of parallel and spaced apart transverse wires 1208. The transverse wires 1208 essentially provide the oven rack surface.

The spaced apart cross wires 1206 can each be connected at their respective ends to a pair of opposing slide devices 1210. The slide devices 1210 can be substantially similar to the slide devices 1020 previously described herein with respect to the rack assembly 1000. That is, the slide devices 1210 can each include an outer stamping 1226 and ball bearing slide 1212. The ends of the cross wires 1206 can be coupled into the ball bearing slides 1212 in any suitable manner.

Figure 32:
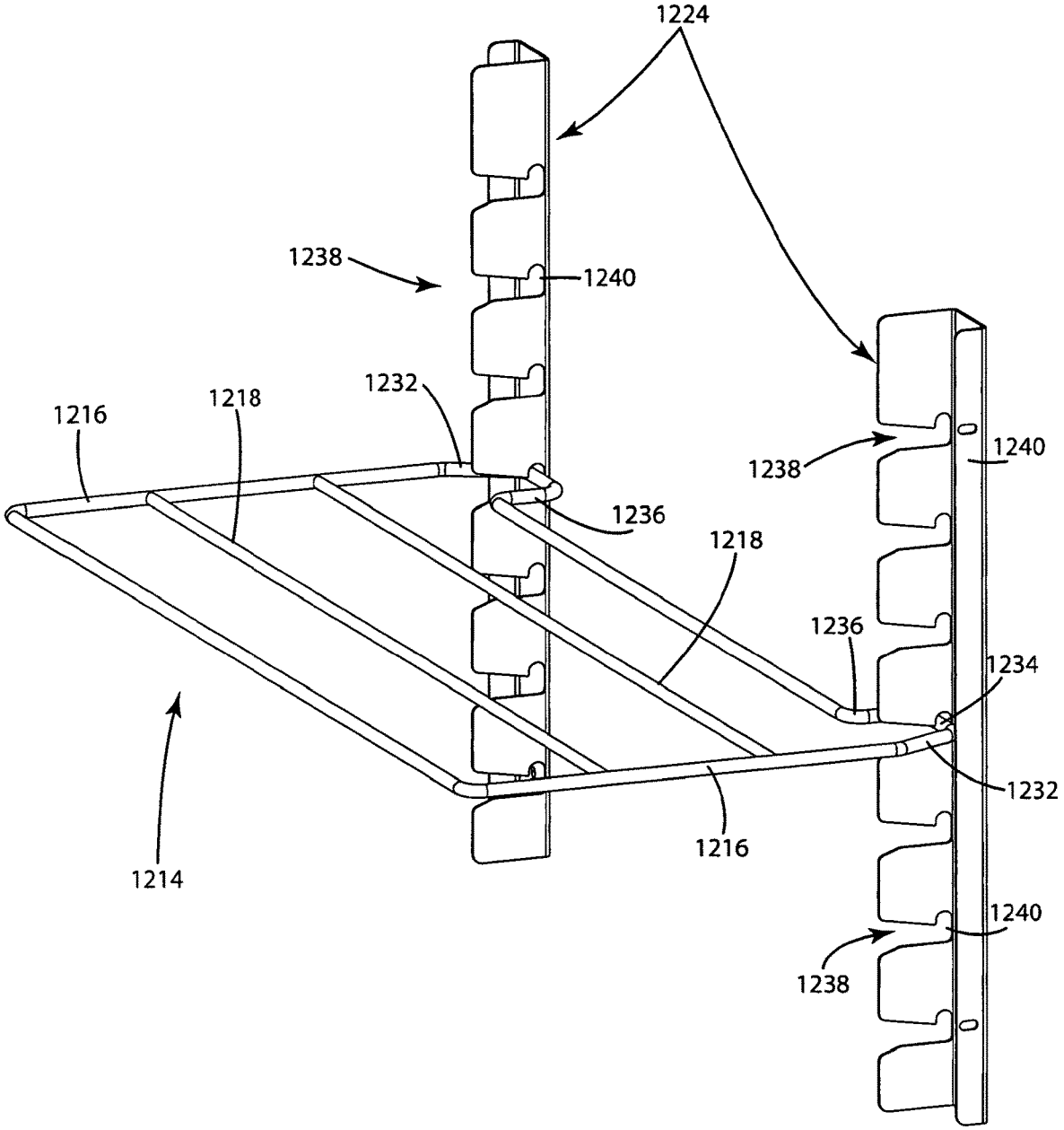
FIG. 32 is a perspective and stand-alone view, showing the positionable relationship of the subframe and the pair of rear ladder catches, when the subframe is releasably coupled to the ladder catches.

In addition to the oven rack 1204, the oven rack assembly 1200 also includes a subframe 1214. The subframe 1214 is particularly shown in a stand alone configuration (i.e., independent of the oven rack 1204 and slides devices 1210) in FIG. 32. With reference to FIG. 32 and others of the drawings, the subframe 1214 includes a continuous outer wire frame 1216 having the shape and configuration again primarily shown in FIG. 32. A pair of parallel and spaced apart cross wires 1218 extend between opposing sides of the outer wire frame 1216, and can be welded or otherwise suitably connected to the wire frame 1216.

Reference is now made to FIG. 27, with respect to certain elements of the coupling between the subframe 1214, slide devices 1210 and oven rack 1204. With reference thereto, each of these slide devices 1210 includes a pair of tabs 1220 extending vertically downward from the bottom surfaces of the slide devices 1210. These tabs 1220 can be coupled to the slide devices 1210 in any suitable manner. It should be noted that the tabs 1220 will be coupled to portions of the slide devices 1210 which remain stationary when the ball bearing slides 1212 are operated so as to extend the oven rack 1204 outwardly from the oven interior. As further shown in FIG. 27, each of the tabs 1220 includes a slot 1222 which opens toward the oven interior rear surface 1202. As still further shown in FIG. 27, when the subframe 1214 is coupled to the oven rack 1204 and slide devices 1210, each of the cross wires 1218 of the subframe 1214 will have one end captured within the slots 1222 of the tabs 1220. This slot capture will assist in supporting the oven rack 1204 on the subframe 1214. Still further, the tabs 1220 function so as to facilitate relative positioning of the subframe 1214 and remaining portions of the oven rack assembly 1200. Also, it should be noted that the slide devices 1210 may, if desired, be welded or otherwise fixedly connected to the subframe 1214. Still further, and although not specifically shown in the drawings, the sides of the outer wire frame 1216, when the subframe 1214 is positioned within the oven interior, will preferably rest on oven liner ribs, such as the liner ribs 1004 previously described herein with respect to the oven rack assembly 1000.

Figure 28:
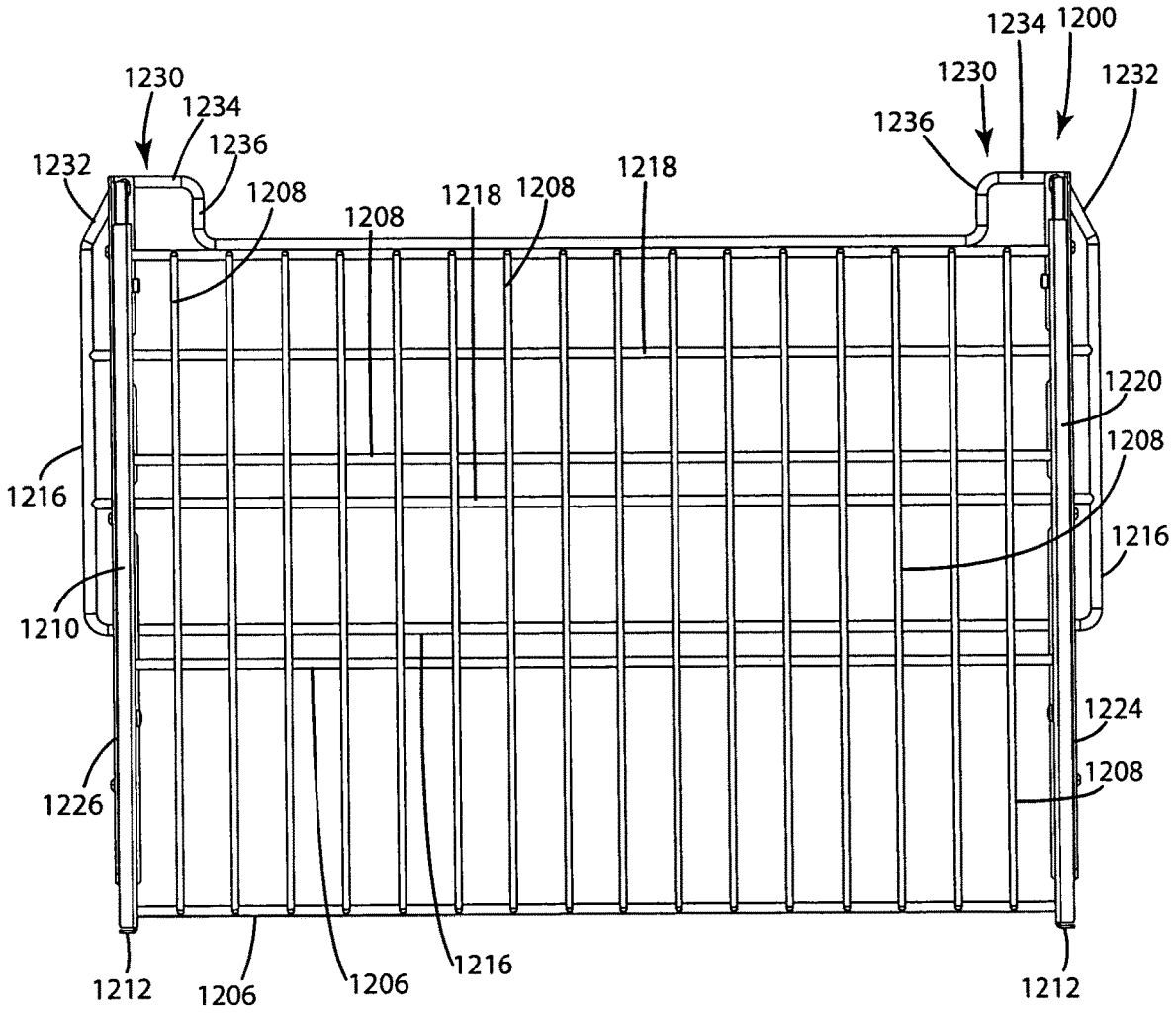
FIG. 28 is a top, plan view of various elements of the further embodiment of the oven rack assembly in accordance with the invention.
Figure 29:
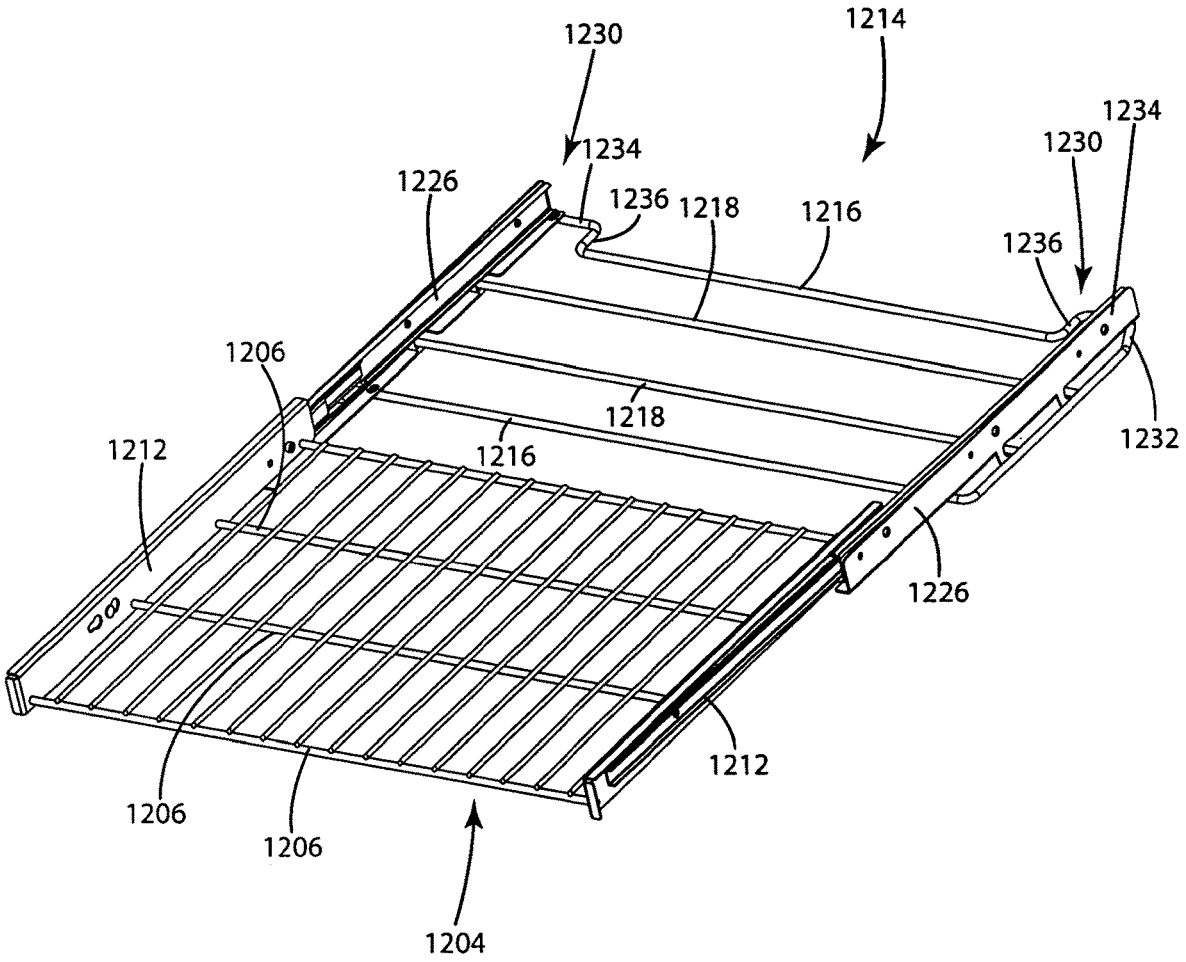
FIG. 29 is a perspective and stand-alone view of the oven rack and slide system used with the rear ladder catches, with the oven rack in an extended position.

In addition to the aforedescribed elements of the oven rack assembly 1200, the assembly 1200 also includes a rear ladder catch system 1242. The rear ladder catch system 1242 incorporates certain principal concepts in accordance with the invention. For purposes of the description, reference is first made back to elements of the subframe 1214. With reference primarily to FIGS. 28 and 32, and as previously described herein, the subframe 1214 includes an outer wire frame 1216. As particularly shown in FIG. 28, located to the rear and to the corners of the subframe 1214 are a pair of opposing outer frame catch sections 1230. These catch sections 1230 preferably form continuous sections of the outer wire frame 1216. More specifically, and again referring primarily to FIGS. 28 and 32, each of the outer frame catch sections 1230 includes an angled portion 1232 extending rearwardly from a corresponding side of the frame section 1216. Formed integral with the angled portion 1232 is a catch portion 1234 which essentially extends laterally relative to the front and rear of the oven. Projecting forwardly from one end of the catch portion 1234, essentially at a right angle thereto, is a longitudinal portion 1236. The longitudinal portion 1236 is integral with the laterally extending rear portion of the wire frame 1216.

In addition to the outer frame catch section 1230, the rear ladder catch system 1242 also includes a pair of vertically oriented ladder catches 1224, having a shape and configuration as primarily shown in FIGS. 26 and 30-32. With reference thereto, each of the rear ladder catches may be fixedly attached to the oven interior surface 1202 (as shown in the drawings or, alternatively, may be additionally or alternatively attached to side walls of the oven. The purpose of the ladder catches 1224 is to hold a rear portion of the subframe 1214 in place, through interaction with the outer frame catch sections 1230. The use of the rear ladder catch system 1242 may be advantageously substituted for the use of any type of release mechanisms involving tabs or other devices which interact with ribs or similar elements on oven side liners. With the rear ladder catch system 1242 in accordance with the invention, the subframe 1214 design is relatively less complicated, and relatively easier to manufacture.

Further, and in accordance with prior descriptions herein, the oven rack assembly 1200 is one which incorporates an oven rack which can be extended outwardly through the use of ball bearing slides. With such extension, cantilever forces are exerted on the subframe, which is to remain stationary during oven rack extension. Such cantilever forces can facilitate the tendency of the subframe to "tip" downwardly at its front portion. However, the rear ladder catch system 1242 in accordance with the invention essentially provides an "anti-tip" feature for the subframe.

Turning now to the specifics of the ladder catches 1224, each of the rear ladder catches may be a stamped metal part. Each ladder catch 1224 is vertically disposed and includes a series of spaced apart ladder catch openings 1238 as particularly shown in FIGS. 26 and 30-32. Each ladder catch opening 1238 is open toward the front of the oven rack assembly 1200. Located at the rear of each ladder catch opening 1238, and positioned upwardly therefrom, is a ladder catch slot 1240. Each ladder catch slot 1240 opens downwardly toward its corresponding ladder catch opening 1238.

Figure 30:
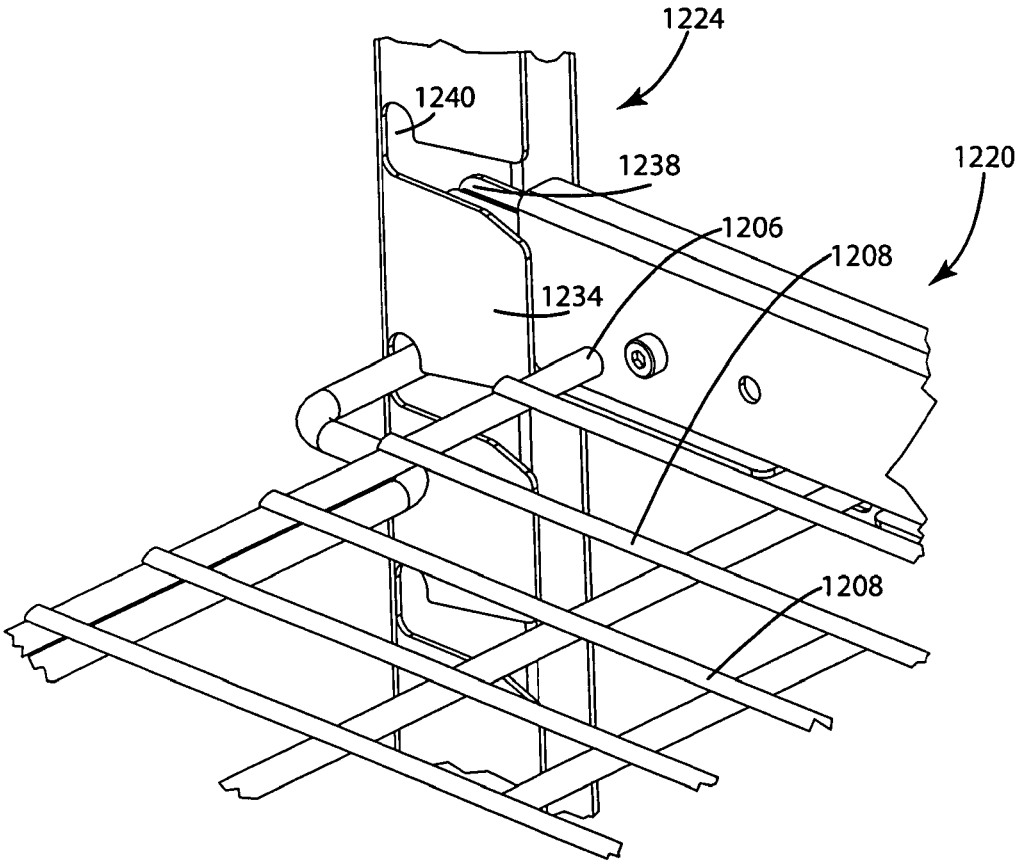
FIG. 30 is a perspective and close up view showing the releasable coupling of one portion of the oven rack with one of the rear ladder catches.
Figure 31:
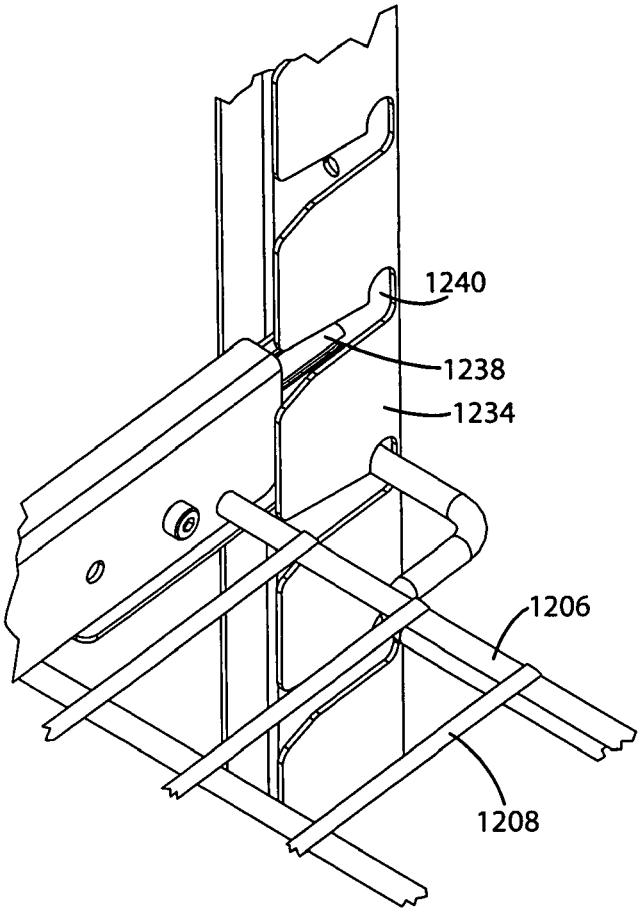
FIG. 31 is a perspective and close up view similar to FIG. 30, but showing a portion of the oven rack as it is releasably coupled to the other rear ladder catch.

As shown particularly in FIGS. 30-32, the subframe 1214 can be mounted to the rear ladder catches 1224 by inserting the catch portion 1234 of the outer frame catch sections 1230 into the ladder catch openings 1238. When the catch portions 1234 are fully inserted into the catch openings 1238, the catch portions 1234 can be received within the ladder catch slots 1240. With the configuration of the subframe 1214 and the weight of its components forward of the catch portions 1234, the catch portions 1234 will move partially upwardly into the catch slots 1240. Correspondingly, the opposing sides of the outer wire frame 1216 can rest on oven liner ribs or similar components associated with the sides of the oven liner (not shown in FIGS. 30-32). The oven rack 1204 and the associated slide devices 1210 can be removably coupled to the subframe 1214 as described in previous paragraphs herein.

The prior description of the rear ladder catch system 1242 has included disclosure with respect to the use of a full-sized oven rack. However, the concept of the rear ladder catch system 1242 can also be utilized with other types of oven racks, such as the half-rack assembly 1400 illustrated in FIGS. 33 and 34. The concepts of the use of ladder catches 1224 as previously described with regard to oven rack assembly 1200 are substantially identical to the concepts and elements associated with the use of ladder catches with half-rack assembly 1400. Accordingly, neither FIG. 33 nor FIG. 34 illustrates any type of ladder catch, since the assembly 1400 can be utilized with the ladder catches 1224 previously described herein.

Figure 33:
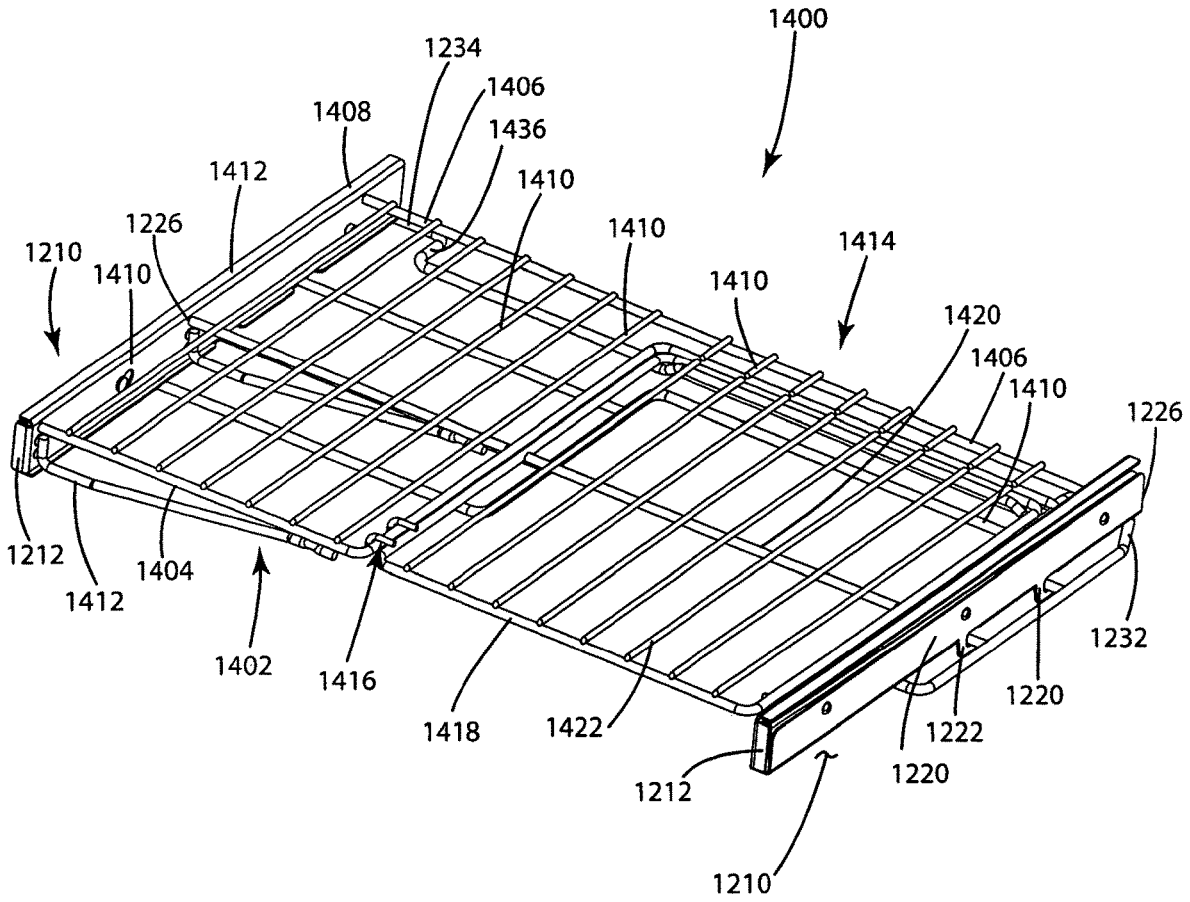
FIG. 33 is a perspective view of an alternative embodiment of an oven rack assembly and ladder catches in accordance with the invention, showing a stand alone view of a half rack and the slide system associated therewith.
Figure 34:
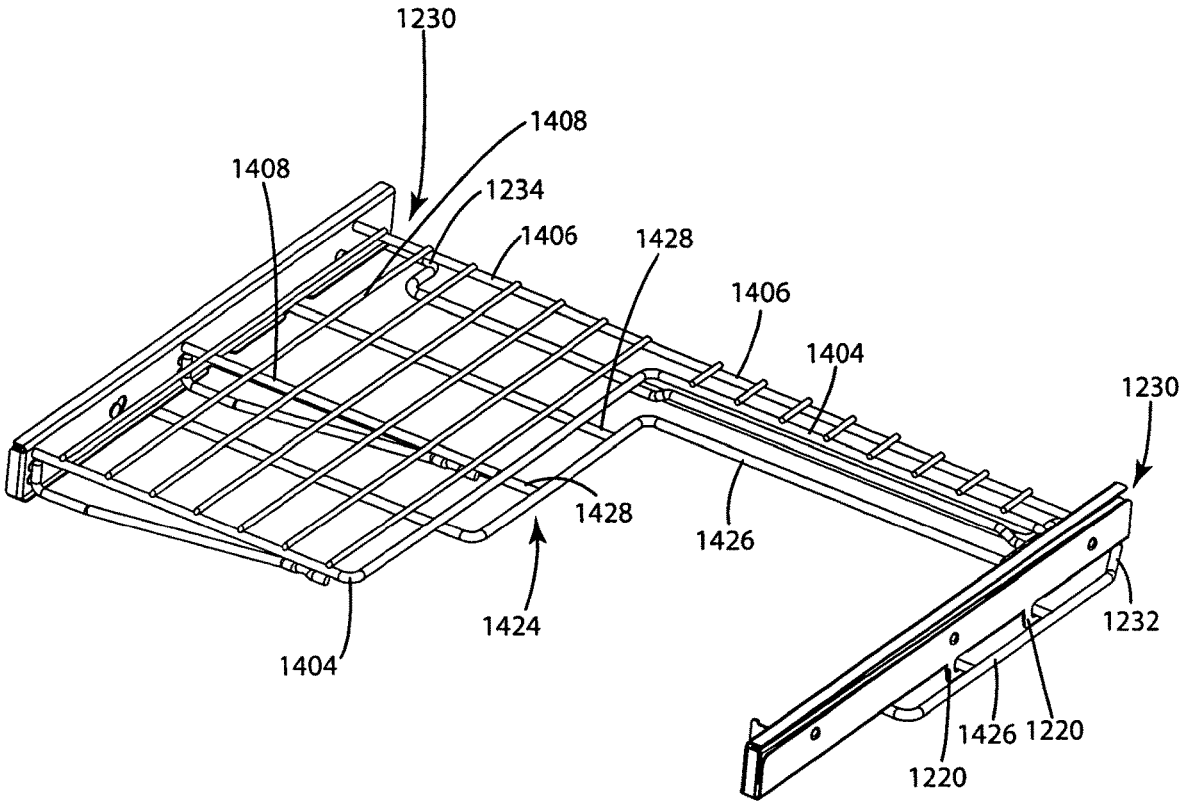
FIG. 34 is a perspective and stand alone view similar to FIG. 33, but showing the oven rack assembly with the half rack removed from the assembly.

With reference to FIGS. 33 and 34, a half-rack assembly 1400 is shown, having a permanent rack 1402 and a removable half-rack 1414. The concept of removable half-rack assemblies is known in the art. The permanent rack 1402 includes an elongated front wire frame 1404 having the configuration primarily shown in FIG. 34. The rack 1402 also includes a rear wire 1406. Cross wires 1408 also form part of the permanent rack 1402. The ends of the wire frame 1404, rear wire 1406 and cross wires 1408 are connected either to the slide devices 1210 or, in the case of the cross wires 1408, to both a slide device 1210 and to the front wire frame 1404. Correspondingly, the permanent rack 1402 also includes a series of parallel and spaced apart transverse wires 1410. These wires extend from the front to the rear of the permanent rack 1402. Still further, the permanent rack 1402 also includes a series of support braces 1412. As shown in FIGS. 33 and 34, one end of each support brace 1412 is welded or otherwise connected to a slide device 1210, while the other end of each support brace 1412 is welded or otherwise connected to the front wire frame 1404 or the cross wire 1408.

As with the oven rack assembly 1200, the half-rack assembly 1400 also includes the slide devices 1210, with each slide device having a ball bearing slide 1212 and an outer stamping 1226. Extending downwardly from each slide device 1210 are a set of tabs 1220, with slots 1222 opening toward the rear of the half-rack assembly 1400. The half-rack assembly 1400 also includes a removable half-rack 1414, as illustrated in FIG. 33. The removable half-rack 1414 includes a rack connector 1416 utilized to connect to and to obtain support from the permanent rack 1402. The half-rack 1414 also includes an outer wire frame 1418, along with a cross wire 1420. Transverse wires 1422 extend between front and rear portions of the outer wire frame 1418. In addition to the foregoing components, the half-rack assembly 1400 also includes a subframe 1424. The subframe 1424 is best illustrated in FIG. 34. As shown therein, the subframe 1424 includes an outer wire 1426 which is continuous and forms a periphery of the subframe 1424. A series of cross wires 1428 extend between opposing legs of the outer wire 1426. As with the subframe 1214 previously described with the oven rack assembly 1200, the subframe 1424 also includes, as portions of the outer wire 1426, outer frame catch sections 1230, located at the rear and opposing corners of the half-rack assembly 1400. Each of the outer frame catch sections 1230 includes an angled portion 1232, catch portion 1234 and longitudinal portion 1236. These portions of the catch section 1230 function in the identical manner as those previously described herein with respect to the oven rack assembly 1200. That is, the catch portions 1234 of the subframe 1424 are captured within openings and slots of rear ladders.

It will be apparent to those skilled in the pertinent arts that other embodiments of oven rack assemblies in accordance with the invention can be designed. That is, the principles of rack assemblies are not limited to the specific embodiments described herein. Accordingly, it will be apparent to those skilled in the art that modifications and other variations of the above-described illustrative embodiments of the invention may be effected without departing from the spirit and scope of the novel concepts of the invention.

What is claimed is:

1. An oven rack assembly adapted for use within an oven cavity having oven cavity side liners, said oven rack assembly comprising:

an oven rack extendable between a retracted position within said oven cavity, and an extended position where said oven rack has moved forwardly relative to said oven cavity;

a slide system comprising a pair of opposing slide devices coupled to said oven rack for providing the capability of said oven rack to move between said retracted position and said extended position; and retention/release means mounted to said slide devices and comprising means manually operable by a user for selectively maintaining said oven rack assembly in a stationary position within said oven cavity, and for selectively releasing said oven rack assembly so that the entirety of said oven rack assembly can be completely removed from said oven cavity; and said retention/release means comprises at least one retention/release device having a retainer tab operably coupled with a retention spring, the retention spring being rotatably mounted about a vertical axle to selectively rotate, thereby moving the retainer tab laterally, the retention/release device further having a lever operably coupled with the retainer tab to move the retainer tab laterally inwardly to release said oven rack assembly, the retention/release device functioning in response to said user exerting and releasing external forces on said lever so as to selectively release said oven rack assembly and permit removal of said oven rack assembly completely from said oven cavity.

2. An oven rack assembly in accordance with claim 1, characterized in that said oven rack comprises a permanent rack and a removable half-rack.

* * * * *